US006803894B1

(12) United States Patent
Hirota et al.

(10) Patent No.: US 6,803,894 B1
(45) Date of Patent: Oct. 12, 2004

(54) LIQUID CRYSTAL DISPLAY APPARATUS AND METHOD USING COLOR FIELD SEQUENTIAL DRIVING METHOD

(75) Inventors: Shoichi Hirota, Hitachi (JP); Makoto Tsumura, Hitachi (JP); Iwao Takemoto, Mobara (JP)

(73) Assignee: Hitachi, Ltd., Tokyo (JP)

( * ) Notice: Subject to any disclaimer, the term of this patent is extended or adjusted under 35 U.S.C. 154(b) by 35 days.

(21) Appl. No.: 09/666,534

(22) Filed: Sep. 20, 2000

(30) Foreign Application Priority Data

Mar. 8, 2000 (JP) ..... 2000-068618

(51) Int. Cl.[7] ..... G09G 3/36
(52) U.S. Cl. ..... 345/88; 345/102
(58) Field of Search ..... 345/87, 88, 89, 345/98, 99, 100, 102; 348/751, 760, 761, 744; 349/5; 353/88

(56) References Cited

U.S. PATENT DOCUMENTS 5,805,243 A * 9/1998 Hatano et al. ..... 349/5
5,957,560 A * 9/1999 Do et al. ..... 353/88
6,115,016 A * 9/2000 Yoshihara et al. ..... 345/88

FOREIGN PATENT DOCUMENTS

JP 10-161610 6/1998

OTHER PUBLICATIONS

N. Ogawa et al. Field–Sequentially–Color LCD Using Switched Organic EL Backlighting:, Society For Information Display (SID), 1999, May, pp. 1098–1101.*

* cited by examiner

*Primary Examiner*—Xiao Wu
(74) *Attorney, Agent, or Firm*—Antonelli, Terry, Stout & Kraus, LLP

(57) ABSTRACT

The driving voltages for monochromatic images are sequentially applied to each of a plurality of pixels included in the display unit so as to cause each of the pixels to sequentially display the monochromatic images. A time-sequential arrangement of the driving voltages for the 2s (s is an integer equal to or larger than 2) monochromatic images that include the three primary colors of red, blue, and green is employed as one unit. Then, the one unit of arrangement of the driving voltages is sequentially applied periodically to each of the pixels included in the display unit so as to cause each of the pixels to sequentially display the monochromatic images arranged in accordance with the arrangement, wherein a color of the monochromatic image is any one of the three primary colors of red, blue, and green, each of the pixels included in the display unit being caused to display the monochromatic image at one point in time.

24 Claims, 21 Drawing Sheets

102
B R G B R G B R G B R G B R G B R G B R G B
TIME
$V_{B1}$
$V_{R1}$
$V_{G2}$
$V_{DC}$
0
$-V_{G1}$
$-V_{R2}$
$-V_{B2}$
DRIVING VOLTAGES

B R G B R G B R G B R G B R G B R G B R G
TIME
$I_{G1}$
$I_{G2}$
$I_{R2}$
$I_{R1}$
$I_{B2}$
$I_{B1}$
LUMINANCES
APPLIED VOLTAGES [Vrms]

102
B R G B R G B R G B R G B R G B R G B R G B
TIME
103
$V_{B1}$
$V_{R1}$
$V_{G2}$
0
$-V_{G1}$
$-V_{R2}$
$-V_{B2}$
DRIVING VOLTAGES $I_{G1}$
$I_{G2}$
$I_{R2}$
$I_{R1}$
$I_{B2}$
$I_{B1}$
$V_{G1}$
$V_{G2}$
$V_{R2}$
$V_{R1}$
$V_{B2}$
$V_{B1}$
LUMINANCES

TIMING CIRCUIT
MEMORY CONTROLLER
FRAME MEMORY
SCANNING CIRCUIT
LATCH
D/A
1ST LINE
i-th LINE
n-th LINE
m-th COLUMN
j-th COLUMN
1ST COLUMN
Hsync
Vsync
St
Vsl
120
121
122
123
124
125
126
127
138

TIME
102
103
R G B X
R G B X
R G B X
T T T αT

Dlj
(DRj, DGj, DBj, DXj)

DOj
(DORj+DOGj+DOBj+DOXj)

FRAME TIMING SIGNALS SF

READING TIMING SIGNALS SP5
SUBFRAME TIMING SIGNALS SP6

ROW TIMING SIGNALS SP4

(i) 2Vg+3Vr−Vb (ii) 2Vg+3Vr−3Vb (iii) 2Vg+Vr−Vb (iV) 2Vg+Vr−3Vb (V) 2Vg−Vr−Vb (Vi) 2Vg−Vr−3Vb (Vii) 2Vg−3Vr−3Vb SUBFRAME POLARITY INVERTING SIGNALS SP10
VDji
102
101
103
t
RGBRBGRBRGBRGBRG

FIG. 14C FRAME TIMING SIGNALS SF

FIG. 14D READING TIMING SIGNALS SUBFRAME TIMING SIGNALS

FIG. 14E ROW TIMING SIGNALS

LIQUID CRYSTAL DISPLAY APPARATUS AND METHOD USING COLOR FIELD SEQUENTIAL DRIVING METHOD

BACKGROUND OF THE INVENTION

The present invention relates to a liquid crystal display apparatus and its displaying method to which a color field sequential driving method has been applied. More particularly, it relates to a liquid crystal display apparatus using the apparatus and method, such as a wearable display or a projection type display.

At present, as the methods of displaying a color image in a liquid crystal display, the following two methods can mainly be mentioned. One is a three-primary-colors color filter method, and the other is the color field sequential driving method (which is also referred to as a color frame sequential driving method).

The color filter method is as follows: One pixel is divided into three subpixels, and then the three-primary-colors color filter is located in each of the subpixels, and finally the luminance relationship among the respective colors is adjusted, thereby making it possible to implement the color display in the liquid crystal display. This method is the most common of the color display methods used at present. Meanwhile, the color field sequential driving method is as follows: Monochromatic images corresponding to the respective three primary colors are displayed in sequence in time-division at high-speed, thereby taking advantage of an afterimage effect of the eyes so as to cause the observer to visually recognize the image as a color image.

The color filter method requires that one pixel should include three subpixels in order to perform the color display. In contrast to this, the color field sequential driving method allows the color display to be performed with only one subpixel (Hereinafter, in the present specification, one subpixel in the color field sequential driving method is also represented as one pixel). Accordingly, in the color field sequential driving method, it is possible to reduce the number of the pixels down to one-third with the resolution maintained that is the same as the resolution in the color filter method. This condition makes it possible to reduce the driver circuit down to one-third, thereby allowing the power to be saved. Also, in aiming to downsize the display, for the above-described reason, the color field sequential driving method is more advantageous than the color filter method.

Moreover, in the color field sequential driving method, there is no need of using the color filter that absorbs light of unnecessary wavelength and permits light of necessary wavelength alone to pass through. Accordingly, the use of monochromatic light as the backlight makes it possible to obtain a light-utilization ratio that is even higher as compared with the case of the color filter method. Namely, there also exists an advantage that, in comparison with the color filter method, it becomes possible to exceedingly reduce the power consumption needed to achieve the same luminance.

Consequently, the color field sequential driving method having the above-described advantages is particularly important in a small-sized portable type color display required to operate with a low power consumption, such as the wearable display that is expected to become a next-generation portable type color display.

Incidentally as a literature concerning the above-described technologies, there exists Society for Information Display (SID) (99, pp. 1098–1101 N. Ogawa et al. Field-Sequential-Color LCD Using Switched Organic EL Backlighting).

FIGS. 1A to 1D illustrate data such as signal waveforms for explaining the prior arts in the color field sequential driving method.

FIGS. 1A to 1C are signal waveform diagrams for illustrating the following, respectively: FIG. 1A: time variations in driving voltages to a liquid crystal pixel (cell), FIG. 1B: time variations in driving voltages in the case where a direct voltage component is superimposed on the driving voltages to the liquid crystal pixel, FIG. 1C: time variations in luminances of the liquid crystal pixel in the case where the driving voltages in FIG. 1B are applied to the liquid crystal pixel. FIG. 1D illustrates an applied voltage-luminance characteristic in the liquid crystal pixel.

Usually, when displaying an image in a liquid crystal display, an alternating voltage as illustrated in FIG. 1A is applied to an electrode of a liquid crystal pixel, thereby driving the liquid crystal pixel. In an example in FIG. 1A, driving voltages $V_R$, $V_G$, and $V_B$, which cause colors of red (R), green (G), and blue (B) to be displayed respectively in this sequence during one frame time-period 102, are applied to each liquid crystal pixel. Each of the driving voltages $V_R$, $V_G$, and $V_B$ is applied during a subframe time-period 103. Incidentally, although the polarity of each of the driving voltages $V_R$, $V_G$, and $V_B$ is inverted between adjacent frames, the sequence of the colors remains the same in each frame.

However, when the driving is executed using the alternating signal in a transistor circuit in a liquid crystal pixel included in an actual active matrix type liquid crystal display, in, for example, the liquid crystal cell, there occurs a capacitive coupling attributed to a signal electrode and the pixel electrode. This capacitive coupling superimposes a direct voltage component $V_{DC}$ on the driving voltages $V_R$, $V_G$, and $V_B$. FIG. 1B illustrates, as the concrete example, the case where the direct voltage component $V_{DC}$ (in the case in FIG. 1B, $V_{DC}>0$) is superimposed on the driving voltages. Additionally, for your information, the case illustrated in FIG. 1A can be considered as an ideal case where $V_{DC}=0$. In the example illustrated in FIG. 1B, the direct voltage component by the amount of $V_{DC}$ is added to the driving voltage waveforms illustrated in FIG. 1A. Namely, the driving voltage waveforms in FIG. 1B are the same as those in FIG. 1A, but are shifted onto the plus side by the amount of $V_{DC}$. Consequently, even when the same color is displayed in the same liquid crystal cell during a time-period of a certain plurality of frames, the absolute value of the driving voltage for displaying the same color turns out to become different between the adjacent frames between which the polarity of the driving voltage differs (in the case illustrated in FIG. 1B, the driving voltage differs by the amount of $2V_{DC}$). Eventually, towards the pixel having one and the same color, the absolute value of the driving voltage differs between the adjacent frames. This means that the luminance corresponding to the driving voltage differs between the adjacent frames as illustrated in the characteristic diagram in FIG. 1D. FIG. 1C illustrates, introducing the difference in each luminance, a time variation in each luminance corresponding to each driving voltage waveform in FIG. 1B. As is obvious from FIG. 1C, even when the same color is displayed continuously in the same liquid crystal cell, the next frame turns out to become distinguishable because the luminance differs between the adjacent frames. As a consequence of this, the two frames become one period, thus causing flicker (which, here, means a slight amount of blinking of the luminance) to occur. Here, the flicker is synchronized with a frequency that is equal to one-half of the frame frequency.

In order to prevent this flicker, in an ordinary liquid crystal display, the following driving is performed: Towards the pixel having one and the same color, the polarity of the driving voltage is inverted for each column and/or for each row.

SUMMARY OF THE INVENTION

Applying the above-described driving method, however, results in inverting polarities of the driving voltages to each other, the driving voltages occurring in two pixels existing in adjacent columns and/or adjacent rows. This causes a disturbance in an electric field to occur in proximity to the boundary of the pixels. As a result, there occurs a liquid crystal orientation failure in proximity to the boundary of the pixels. The region where the liquid crystal orientation failure has happened is recognized as a display failure. Concealing, with a light-shielding frame, the region where the liquid crystal orientation failure has happened prevents the display failure from being visually recognized, but results in decreasing an aperture ratio greatly. Furthermore, in the case where the pixel pitch is made narrower in order to implement a high-resolution and to downsize the display, a percentage at which the display failure region occupies the entire display region is increased. This makes it inevitable to bring about a serious problem of decreasing the aperture ratio exceedingly. Accordingly, in order to aim to implement the high-resolution and to downsize the display, it is after all required to apply, towards the pixel having one and the same color within the one frame time-period, the driving voltage the polarities of which are identical to each other in both the adjacent columns and the adjacent rows (This driving method is referred to as a frame inversion driving). In this frame inversion driving, however, the problem of the flicker resulting from the above-described direct voltage component still remains without being solved. This requires that this problem should be solved by a method other than the above-described method.

Accordingly, it is an object of the present invention to provide a liquid crystal display apparatus and its displaying method, the apparatus and the method preventing the flicker that occurs when the frame inversion driving is performed in the color field sequential driving, and being adaptable to the implementation of the high-resolution and the downsizing of the display.

According to one aspect of the present invention, there is provided a liquid crystal display apparatus, including:

a display unit including a plurality of pixels, and a driving unit for sequentially applying driving voltages for monochromatic images to each of the plurality of pixels included in the display unit so as to cause each of the pixels to sequentially display the monochromatic images, the driving unit employing, as one unit, a time-sequential arrangement of the driving voltages for the 2s (s is an integer equal to or larger than 2) monochromatic images that include three primary colors of red, blue, and green, and sequentially applying the one unit of arrangement of the driving voltages periodically to each of the pixels included in the display unit so as to cause each of the pixels to sequentially display the monochromatic images arranged in accordance with the arrangement, wherein a color of the monochromatic image is any one of the three primary colors of red, blue, and green, each of the pixels included in the display unit being caused to display the monochromatic image at one point in time.

Accordingly, a polarity of the driving voltage in the monochromatic image having one and the same color always remains one and the same polarity. This makes it possible to exceedingly decrease a difference between absolute values of the driving voltage caused by the polarity inversion of the driving voltage. As a result, it becomes possible to provide a high picture-quality liquid crystal display apparatus exhibiting no flicker.

Also, in addition to the above-described configuration, the following configuration is provided: A polarity of a driving voltage applied to a pixel is controlled arbitrarily for each monochromatic image, thereby making polarities of driving voltages identical to each other, the driving voltages being applied to at least two monochromatic images having one and specified color. This allows conditions of the driving voltages to be classified depending on the cases, thereby making it possible to eliminate a direct voltage component that brings about a degradation in the picture-quality. As a result, it becomes possible to provide a high picture-quality liquid crystal display apparatus.

According to another aspect of the present invention, there is provided a liquid crystal display apparatus, including:

a display unit including a plurality of pixels, and a driving unit for sequentially applying driving voltages for monochromatic images to each of the plurality of pixels included in the display unit so as to cause each of the pixels to sequentially display the monochromatic images, the driving unit employing, as one unit, a time-sequential arrangement of the driving voltages for the 2s (s is an integer equal to or larger than 2) monochromatic images that include three primary colors of red, blue, and green, and sequentially applying the one unit of arrangement of the driving voltages periodically to each of the pixels included in the display unit so as to cause each of the pixels to sequentially display the monochromatic images arranged in accordance with the arrangement, wherein the driving voltage for the monochromatic image is any one of the driving voltages for red, blue, and green, and the 1st driving voltage, the driving voltage being applied at one point in time to each of the pixels included in the display unit.

Accordingly, a polarity of the driving voltage in the monochromatic image always remains one and the same polarity. This makes it possible to exceedingly decrease a difference between absolute values of the driving voltage caused by the polarity inversion of the driving voltage. As a result, it becomes possible to provide a high picture-quality liquid crystal display apparatus exhibiting no flicker.

Furthermore, in addition to the above-described configuration, the following configuration is provided: In a time-period during which one monochromatic image included within the one periodic arrangement is displayed, each of the pixels included in the display unit is not irradiated with light or an observer is prevented from recognizing the light visually, and in the time-period, the driving voltage applied to each of the pixels is set as the 1st driving voltage (correcting voltage). This allows the driving voltage to be set as the correcting voltage, the driving voltage existing in the time-period during which the observer is prevented from recognizing the light visually, and also makes it possible to eliminate the direct voltage component for each periodic arrangement. As a result, it becomes possible to provide the liquid crystal display apparatus exhibiting no flicker and with the high picture-quality.

Also, according to another view point of the present invention, there is provided a liquid crystal display apparatus including a display unit and a driving unit, wherein a color of a monochromatic image that the driving unit displays is any one of the three primary colors, and one frame includes 2s (s is an integer equal to or larger than 2) subframes. Accordingly, a polarity of the driving voltage in the monochromatic image having one and the same color always remains one and the same polarity. This makes it possible to exceedingly decrease a difference between absolute values of the driving voltage caused by the polarity inversion of the driving voltage. As a result, it becomes possible to provide a high picture-quality liquid crystal display apparatus exhibiting no flicker.

BRIEF DESCRIPTION OF THE DRAWINGS

FIGS. 14A to 14E are diagrams for illustrating digital image signals and various types of timing signal waveforms in the 3rd embodiment;

DETAILED DESCRIPTION OF THE EMBODIMENTS

Figure 1B:
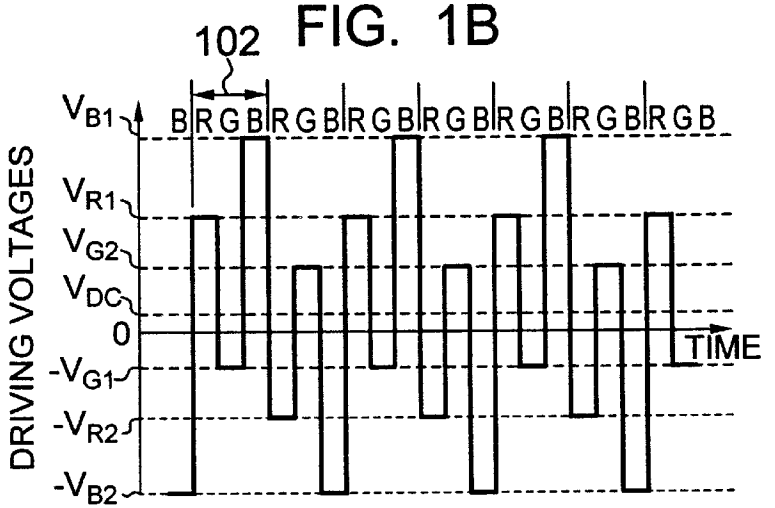
FIGS. 1A to 1D are diagrams for illustrating data such as signal waveforms of driving voltages in a color field sequential driving method in the prior art.

Hereinafter, referring to the drawings, the explanation will be given concerning the embodiments of the present invention. In the following figures, the same reference numeral is assigned to the configuration elements having a similar or the same function.

(1st Embodiment)

First, using data such as signal waveforms illustrated in FIGS. 2A to 2C, the explanation will be given below concerning the overview of a liquid crystal driving method in the 1st embodiment of the present invention.

Figures 2A, 2B, 2C:
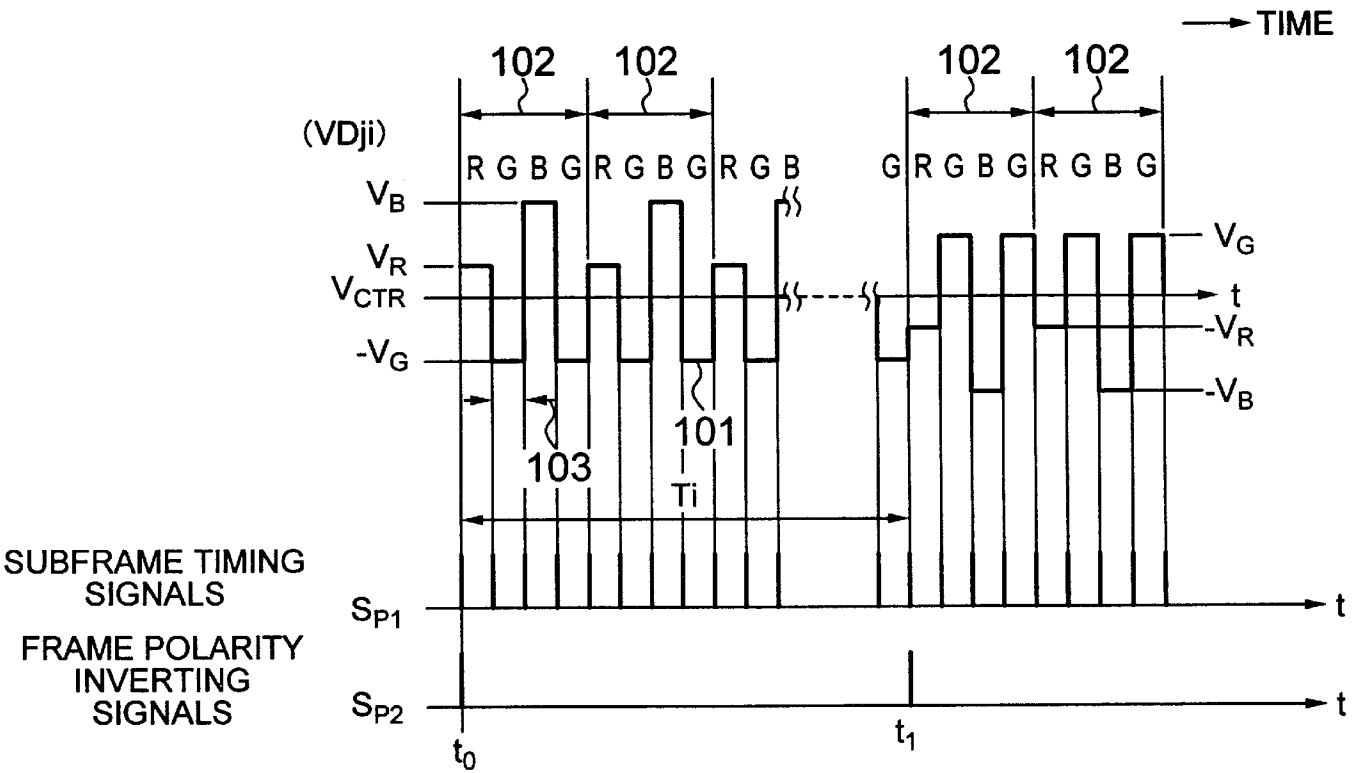
FIGS. 2A to 2C are diagrams for illustrating data such as signal waveforms of driving voltages in a color field sequential driving method in the 1st embodiment of the present invention.

FIG. 2A illustrates the relationship between driving voltages to a certain one pixel of the liquid crystal (VDji: driving voltages to a pixel in the j-th row and the i-th column in the display unit) and time. Here, the transverse axis represents time and the longitudinal axis represents the driving voltages. A driving voltage waveform 101 has a periodic structure (arrangement) the fundamental period of which is a frame time-period 102. The frame time-period 102 further includes a plurality of (here, 4) shorter and finer subframe time-periods 103. Moreover, in each subframe time-period, each of the driving voltages $V_R$, $-V_G$, and $V_B$, (otherwise, $-V_R$, $V_G$, and $-V_B$) that correspond to the three primary colors of red, green, and blue, respectively, is applied to the liquid crystal pixel. In the present specification, an image that is displayed when each of the driving voltages $V_R$, $-V_G$, and $V_B$ is applied is defined and referred to as a monochromatic image. This monochromatic image is constituted by a tone of one color (including black or white). Also, polarities of the driving voltages are inverted for each subframe time-period with a reference voltage $V_{CTR}$ as the center. Incidentally, the sequence of the colors within the frame time-period remains the same within any of the frame time-periods.

In this way, in the present embodiment, a time-sequential arrangement of the driving voltages for the 2s (s is an integer equal to or larger than 2) monochromatic images that include the three primary colors of red, blue, and green is employed as one unit (1 frame). Then, the one unit of arrangement of the driving voltages is sequentially applied periodically to each of the pixels included in the display unit so as to cause each of the pixels to sequentially display the monochromatic images arranged in accordance with the arrangement, wherein a color of the monochromatic image is caused to be any one of the three primary colors of red, blue, and green, each of the pixels included in the display unit being caused to display the monochromatic image at one point in time.

Figure 1C:
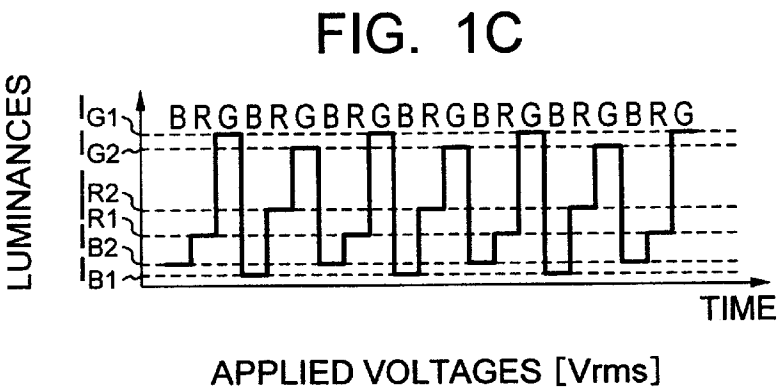
Figure 1A:
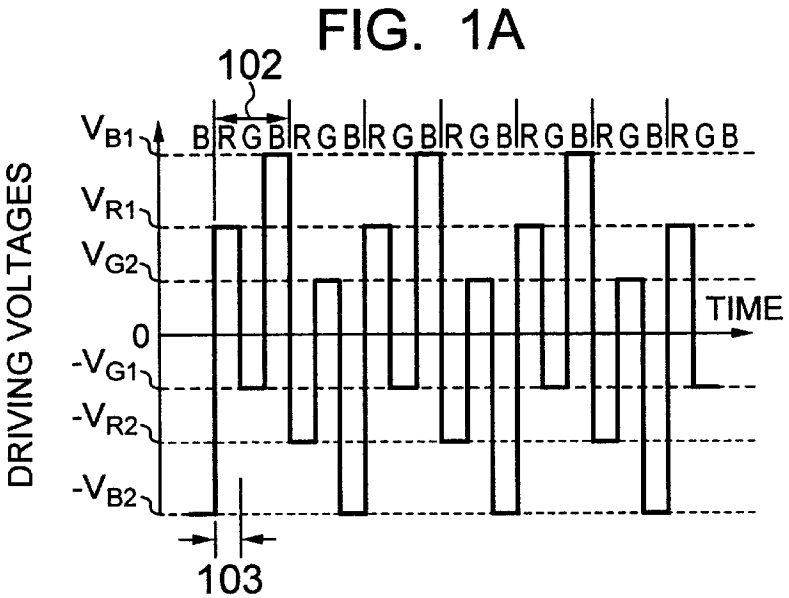
Figure 1D:
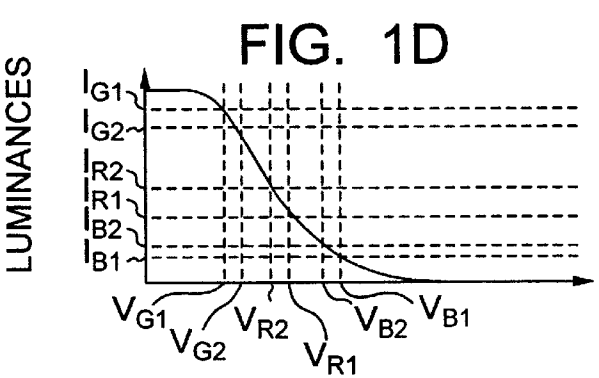

As illustrated in FIG. 1A, FIG. 1B, the conventional method is characterized by the configuration where each frame time-period includes the subframe time-periods the number of which is three in total and which display the colors of red, green, and blue, respectively. Meanwhile, the present embodiment is characterized by the following configuration: The one frame time-period includes the subframe time-periods the number of which is an even number (i.e., 2s, s is an integer equal to or larger than 2). Furthermore, of the subframe time-periods for displaying the colors of red, green, and blue within one and the same frame time-period, there exist a plurality of (two subframe time-periods for displaying one of the colors of red, green, and blue of the subframe time-periods for displaying the colors of red, green, and blue in the case where the one frame time-period includes four subframe time-periods) subframe time-periods for displaying at least one of the colors of red, green, and blue. Even when the rectangular wave-shaped voltage the polarity of which is inverted alternately and continuously between the positive and the negative polarities is applied to the pixel electrode (of course, even when there is provided an interval between the adjacent frame time-periods and between the adjacent subframe time-periods, respectively), by employing the configuration as described above, the driving voltage in a subframe time-period for displaying a certain one and the same color always exhibits one and the same polarity within an arbitrary frame time-period. Namely, it turns out that each of the driving voltages that correspond to the respective colors of red, green, and blue is repeated with one and the same polarity. In the example in FIG. 2A, in the frame time-period 102, the driving voltages are applied in the sequence of red (hereinafter, referred to as "R"), green (hereinafter, referred to as "G"), blue (hereinafter, referred to as "B"), and green (G). Moreover, not only in the next frame time-period but also in the arbitrary frame time-period, the polarity of the driving voltage for each color is kept unchanged.

Next, referring to FIGS. 3A to 3C, the explanation will be given below concerning the details and effects of the driving voltages illustrated in FIG. 2A.

Figure 3A:
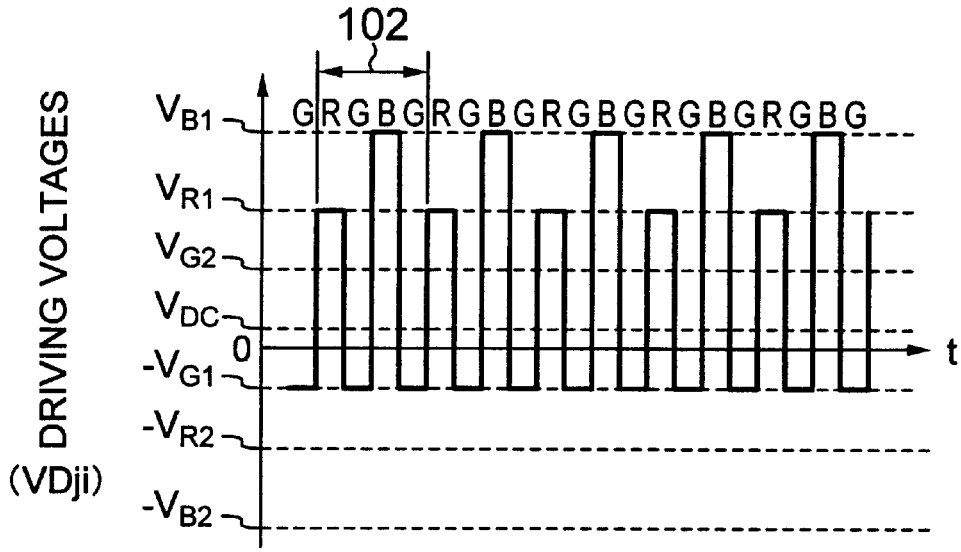
FIGS. 3A to 3C are diagrams for illustrating data such as signal waveforms of driving voltages in the color field sequential driving method in the 1st embodiment of the present invention.
Figure 3B:
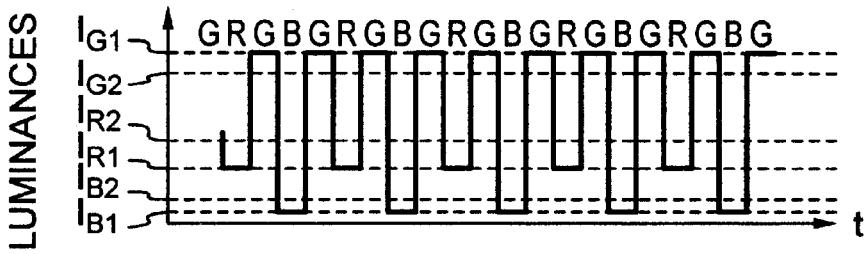
Figure 3C:
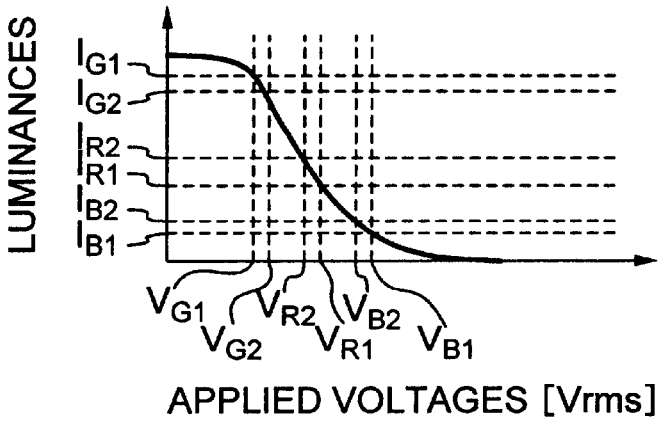

FIGS. 3A to 3C are diagrams for illustrating the following, respectively: FIG. 3A: time variations in the waveforms of the driving voltages (VDji) applied to a liquid crystal pixel, FIG. 3B: time variations in luminances of the liquid crystal pixel in the case where the driving voltages in FIG. 3A are applied to the liquid crystal pixel, FIG. 3C: the relationship between the applied voltages to the pixel and the luminances of the pixel (i.e., the dependence of the luminances on the applied voltages). Based on these drawings, the corresponding explanations will be given below.

FIG. 3A illustrates an example where, as is the case with the driving voltage waveforms in FIG. 2A, in the frame time-period 102, the driving voltages (VDji) are applied to a certain one liquid crystal pixel in the sequence of R, G, B, and G. By employing the configuration like this, each of the driving voltages for the respective colors of R, G, B is always repeated with one and the same polarity. Consequently, even when, as indicated in FIG. 3A, the direct voltage component $V_{DC}$ is superimposed on the driving voltage waveforms, the influence exerted by $V_{DC}$ is always equated and becomes the same in any of the frame time-periods. This makes it possible to exceedingly decrease the difference between absolute values of the driving voltage caused by the polarity inversion of the driving voltage for each frame time-period as was explained in FIGS. 1B, 1C. Accordingly, it becomes possible to reduce the flicker with a 2-frame period.

Consequently, the employment of the driving method in the present embodiment allows the flicker to be greatly reduced, thereby making it possible to provide the high picture-quality liquid crystal display apparatus exhibiting no flicker.

Incidentally, although the three primary colors of R, G, B are used in the present embodiment, it is also possible to employ four colors with an addition of another color and to perform the driving with the use of the four colors. This is made possible because configuring the one frame with the even number of subframes is one of the points in the present embodiment.

In the driving method according to the present embodiment, however, it is undeniable that there still remains a problem of eliminating the direct voltage component $V_{DC}$ itself. For example, in the example in FIG. 3A, driving voltages in subframe time-periods for displaying R and B exhibit a positive polarity, and a driving voltage in a subframe time-period for displaying G exhibits a negative polarity. Here, for example, when performing a monochromatic display of blue to a certain pixel, since the polarity of a driving voltage $V_B$ for displaying blue is positive, i.e., $V_B>0$, the direct voltage component $V_{DC}$ is added to the driving voltage $V_B$. Accordingly, after all, it is impossible to solve the problem that the positive direct voltage component is superimposed on the driving voltage. Consequently, the direct voltage component continues to be applied to one and the same pixel in the liquid crystal layer for a long time, thus bringing about the degradation in the picture-quality such as an afterimage phenomenon. In order to prevent this, it is appropriate enough to invert the polarity of the driving voltage for each of the colors of R, G, B on a certain fixed length of time (a plurality of frame time-periods) basis. Namely, for example, as illustrated in FIG. 2A, for each fixed length of time Ti and in response to a frame polarity inverting signal SP2 illustrated in FIG. 2C, the polarity of the driving voltage for each of the colors of R, G, B within the frames subsequent thereto is inverted toward the polarity of the driving voltage within the frames prior thereto. Incidentally, FIG. 2B illustrates subframe timing signals SP1. In synchronization with the timing signals, the subframe time-period of each driving voltage illustrated in FIG. 2A is determined and the polarity of each driving voltage is inverted. The certain fixed length of time Ti referred to here, which is a value determined experimentally in correspondence with a liquid crystal material employed and the afterimage characteristic of an orientation film, is equal to p (p is an integer larger than 2) frame time-periods. In addition, for example, in a display apparatus performing a display where only a specified color from among the colors of R, G, B is used a lot, it is required to execute the polarity inversion on a comparatively short time basis. Otherwise, it is allowable to add the following circuit configuration: An image signal is monitored so as to integrate the direct voltage component of the image signal, and when the integrated value exceeds a certain constant value, the polarity inversion is executed.

Additionally, although the one frame is divided into the four subframes in the present embodiment, it is well enough to divide, as was described earlier, the one frame into the even number of subframes. Also, concerning the sequence of displaying the colors of R, G, B, the various kinds of combinations can be considered, and thus the sequence is not limited to that of the present embodiment.

Figure 4:
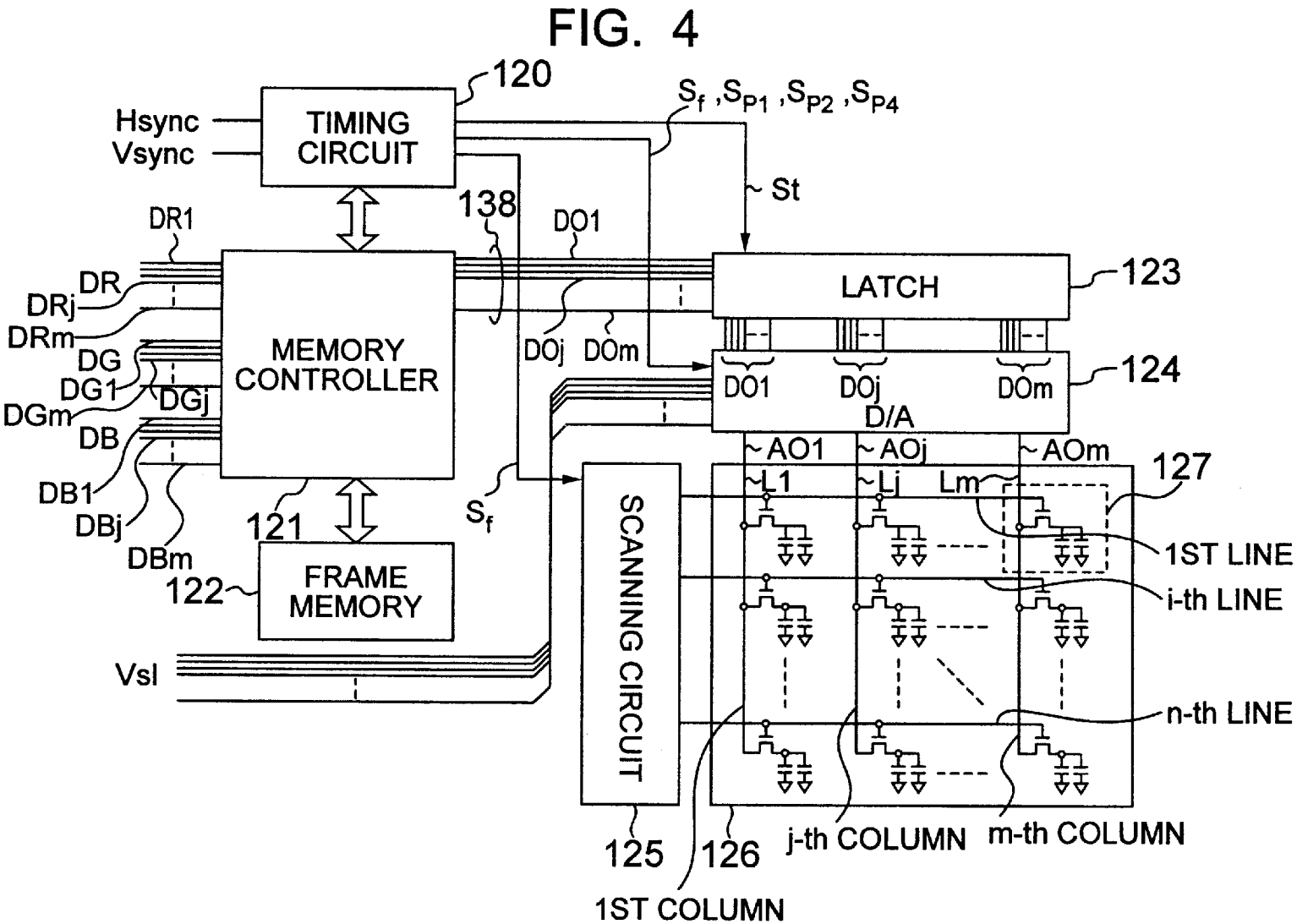
FIG. 4 is a block diagram for illustrating a configuration example of a circuit of a liquid crystal display apparatus according to the present invention.

FIG. 4 is a block diagram for illustrating a circuit configuration example of a main portion of the liquid crystal display apparatus in the present invention, the example being designed for implementing the above-described and the following embodiments.

In FIG. 4, a timing circuit 120 generates various types of timing signals from a horizontal synchronization signal Hsync and a vertical synchronization signal Vsync, then outputting the timing signals to a latch 123, a digital-analogue (D/A) converter 124, and a scanning circuit 125, respectively.

Meanwhile, digital image signals DR, DG, DB for R, G, B, after being inputted into a memory controller 121, are stored into a frame memory 122. In addition, the memory controller 121 reads the digital image signals from the frame memory 122 with a certain timing, thereby generating field sequential digital image signals 138 (DOj) (j is integers ranging from 1 to m: DOj denotes the field sequential digital image signals for the pixels in the j-th column in a display unit 126). The field sequential digital image signals are temporarily latched in the latch 123 in accordance with a timing signal St created by the timing circuit 120. Furthermore, the digital image signals are inputted from the latch 123 into the digital-analogue converter 124, then being merged with a reference voltage $V_{s1}$. Based on timing signals Sf, SP1, SP2, SP4 from the timing circuit 120 that will be described later, the digital-analogue converter 124 converts the field sequential digital image signals DOj inputted and merged with the reference voltage $V_{s1}$ in this way into analogue image signals AOj (j is integers ranging from 1 to m: AOj denotes the analogue image signals (the driving voltages) for the pixels in the j-th column in the display unit 126). Based on a timing signal Ss from the timing circuit 120, the scanning circuit 125 generates a timing signal. The digital-analogue converter 124 causes the analogue image signals AOj to correspond to the timing signal generated from the scanning circuit 125, outputting the analogue image signals to signal lines Lj (L1-Lm). Moreover, the analogue image signals are provided, as the driving voltages (VDji), to the corresponding pixels in the j-th column in the display unit 126 including a plurality of pixels 127. Here, it is assumed that the display unit 126 includes m×n pixels formed like a matrix with m columns and n rows.

Incidentally, in the present specification, the collection of the circuits, which has the series of functions ranging from generating and outputting the field sequential digital image signals to causing the display unit to display the image, is defined as the driving unit. In the present embodiment, as its concrete example, the driving unit includes components such as the digital-analogue converter 124, the scanning circuit 125, and the latch 123. As long as the driving unit has the above-described functions, however, it is not limited to the configuration in the present embodiment. Also, in the present specification, a light source unit is assumed to be included in the driving unit, the light source unit being synchronized with the field sequential digital image signals so as to irradiating the display unit with the monochromatic light sequentially.

Figure 5:
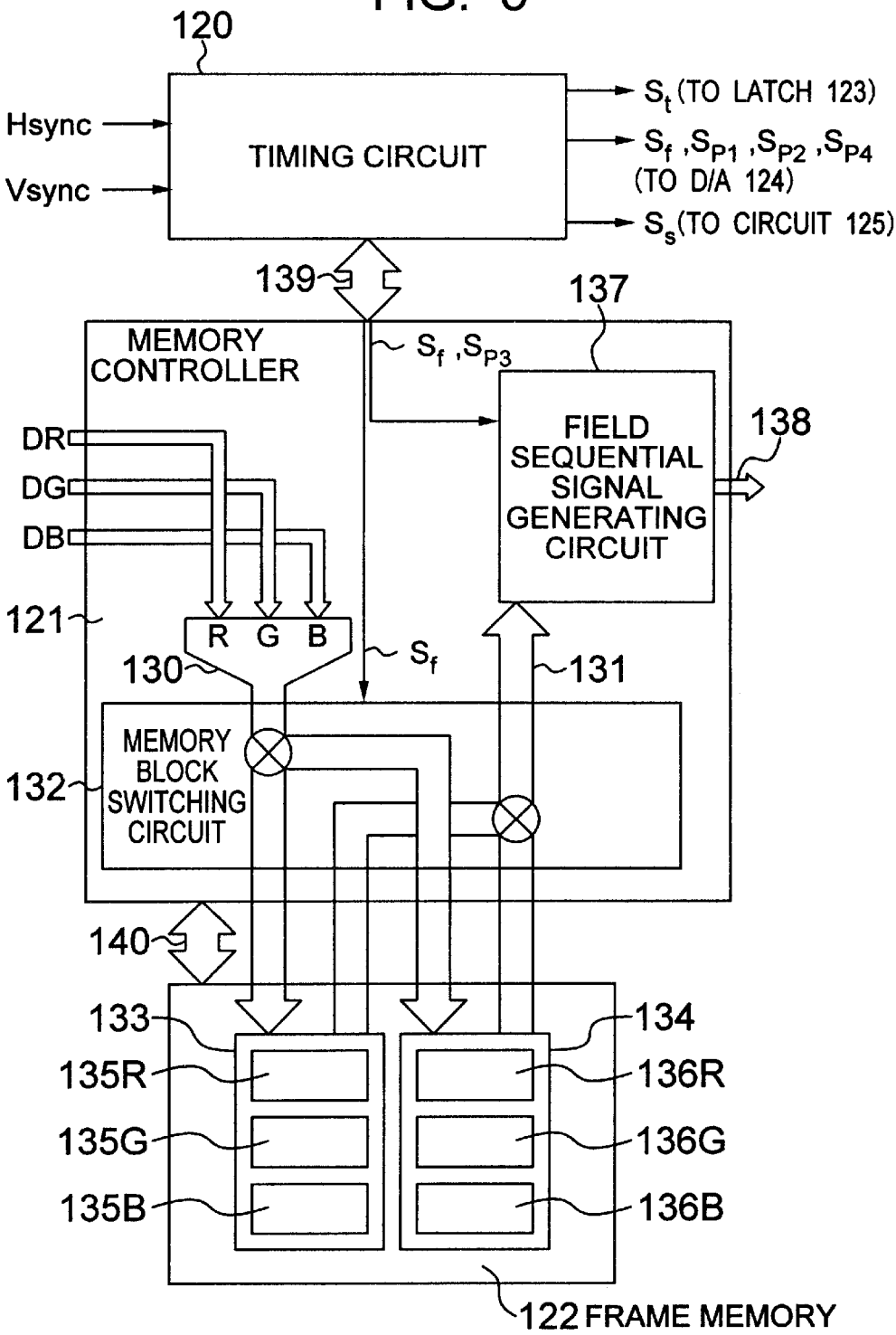
FIG. 5 is a block diagram for illustrating configuration examples of a frame memory and a memory controller in the 1st embodiment of the liquid crystal display apparatus according to the present invention.

FIG. 5 illustrates the inner configurations of the frame memory 122 and the memory controller 121 in more detail.

The memory controller 121 includes the following components: A memory block switching circuit 132, a field sequential signal generating circuit 137, and a generating circuit (not illustrated) for generating timing signals 140 for controlling a writing-in and a reading-out of data towards the frame memory 122.

First, the digital image signals DR, DG, DB for R, G, B are stored into the frame memory 122 by way of a bus 130 and the memory block switching circuit 132. The frame memory 122 has a memory capacity for storing at a time the signals by the amount of two frames the one frame of which includes three subframes including the digital image signals for the three colors, i.e., the signals by the amount of six subframes in total. In the present embodiment, the frame memory 122 has the 1st frame memory block 133 and the 2nd frame memory block 134 that each store the signals in a unit of one frame. The frame memory block 133 and the frame memory block 134 has subframe memory blocks 135R, 135G, 135B and 136R, 136G, 136B that store the digital image signals DR, DG, DB in the subframe time-periods for red, green, and blue, respectively. Even when the frame memory 122 has a memory capacity by the amount of only one frame, displaying the image is possible. However, the timings of the writing-in and the reading-out spread over partially between the frames prior and subsequent thereto. This condition gives rise to an error in the voltage in the image that moves at high-speed within the screen, thereby resulting in a possibility that there occurs a slight amount of color shift. Accordingly, in supplying the voltage precisely, it is more preferable to select a configuration where there is provided the memory block by the amount of two frames and the memory block to be used is switched for each frame. Namely, in response to the frame timing signal Sf, the memory block switching circuit 132 switches, for each frame, between the frame memory block into which the signals are written and the frame memory block from which the signals are read. Namely, in response to the timing signals 140 (the frame signals Sf, the subframe signals SP1), the digital image signals DR, DG, DB in, for example, the n-th frame are written into the frame memory block 133 and are read therefrom, and the digital image signals DR, DG, DB in the next (n+1)-th frame are written into the frame memory block 134 and are read therefrom. Additionally, it is assumed that each of the storage contents in the frame memory blocks 133, 134 is overwritten when the digital image signals are written next.

In response to the frame timing signals Sf, SP3, the field sequential signal generating circuit 137 sequentially reads, in a unit of each color, the digital image signals for R, G, B stored in the frame memory 122. Then, the circuit fetches the image signals by way of the memory block switching circuit 132 and a bus 131, thus generating the field sequential digital image signals 138.

Figures 6A, 6B, 6C, 6D, 6E, 6F, 6G, 6H, 6I:
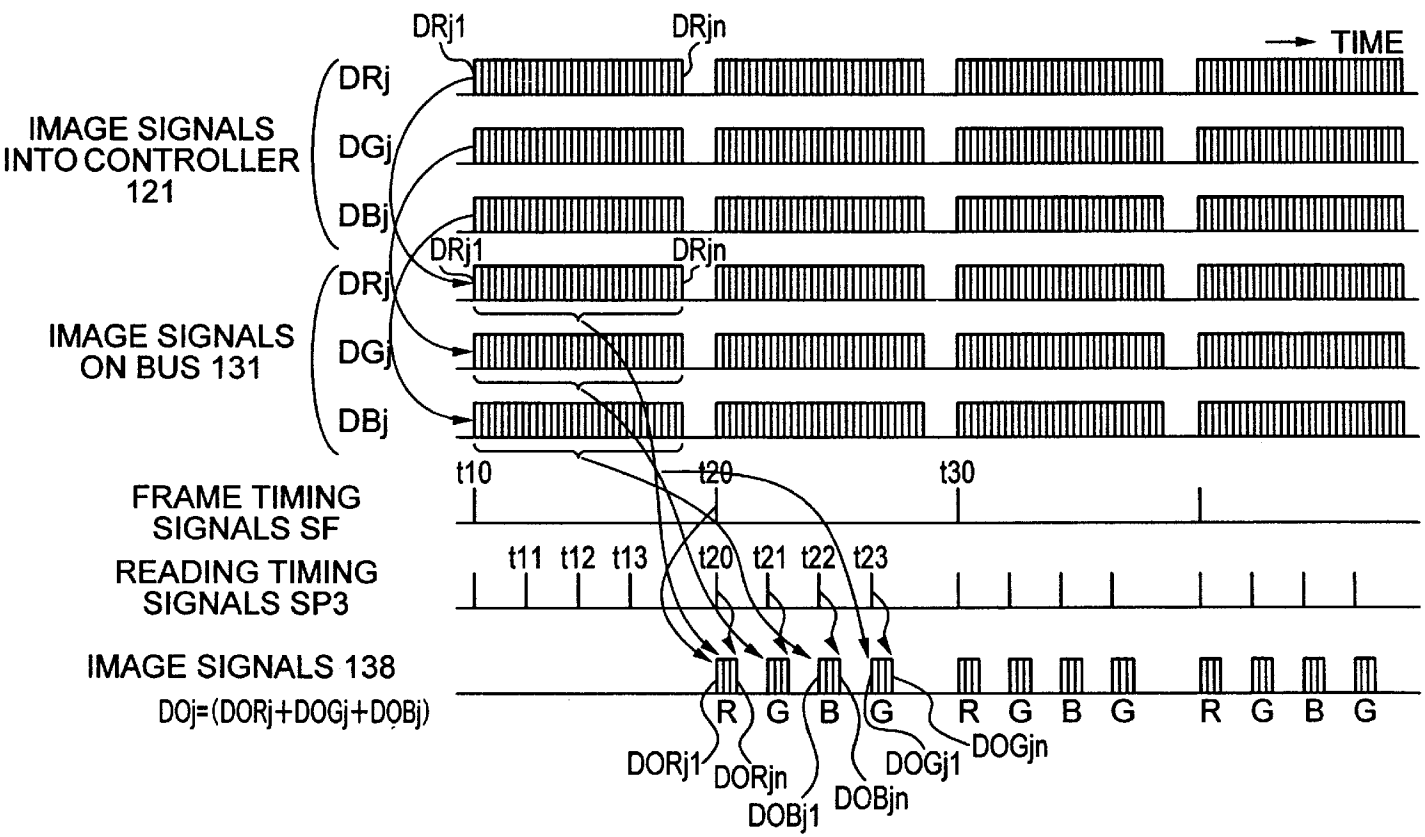
FIGS. 6A to 6I are timing charts for illustrating examples of signal waveforms of the respective portions for explaining operations of the frame memory and the memory controller in the 1st embodiment of the liquid crystal display apparatus.

Next, referring to signal waveforms in FIGS. 6A to 6I and FIGS. 7A to 7G, the explanation will be given below regarding the details of the operation of the configurations illustrated in FIGS. 4, 5. FIGS. 6A to 6C illustrate a portion of the digital image signals DR, DG, DB into the frame memory 122, i.e., for example, digital image signals DRj, DGj, DBJ in the j-th column. Additionally, as illustrated in FIG. 4, the digital image signal DR for red includes DR1 (digital image signal in the 1st column) to DRm (digital image signal in the m-th column), the digital image signal DG for green includes DG1 (digital image signal in the 1st column) to DGm (digital image signal in the m-th column), and the digital image signal DB for blue includes DB1 (digital image signal in the 1st column) to DBm (digital image signal in the m-th column).

The digital image signals in each column illustrated in FIGS. 6A to 6C, such as DRj, DGj, DBj, are written into the frame memory block 133 and the frame memory block 134 alternately in the unit of one frame (FIGS. 6D, 6E, 6F).

The field sequential signal generating circuit 137 reads, from the frame memory 122, the digital image signals DRj, DGJ, DBj in each column. Then, the circuit generating generates the field sequential digital image signals 138 for each color in the j-th column (DOj, m≧j≧1: DORj+DOGJ+DOBj) (FIG. 6I) in the sequence of R, G, B, and G, thus outputting the digital image signals to the latch 123. Namely, as illustrated in FIG. 4, the field sequential digital image signals 138 including field sequential digital image signals DO1 in the 1st column to field sequential digital image signals DOm in the m-th column are provided to the latch 123 in parallel.

Namely, for example, the digital image signal DRj (the digital image signal for red in the j-th column) read from the frame memory 122 is generated as the field sequential digital image signal DORJ (the field sequential digital image signal for red in the j-th column) (FIG. 6I) with timings (for example, a point in time t20) given by the frame timing signals Sf (FIG. 6G) and the reading timing signals SP3. Namely, for example, the digital image signal DRj1 for red in the j-th column and the 1st row to the digital image signal DRjn for red in the j-th column and the n-th row in FIG. 6D are generated as the field sequential digital image signal DORj1 for red in the j-th column and the 1st row to the field sequential digital image signal DORjn for red in the j-th column and the n-th row in FIG. 6I.

The digital image signal DGj for green (i.e., DGj1 to DGjn) is similarly generated as the field sequential digital image signal DOGJ (i.e., DOGj1 to DOGjn) with timings (for example, points in time t21 and t23) given by the reading timing signals SP3. Also, the digital image signal DBj for blue (i.e., DBj1 to DBjn) is similarly generated as the field sequential digital image signal DOBJ (i.e., DOBj1 to DOBjn) with timings (for example, a point in time t22) given by the timing signals SP3.

In this way, DOj is a bit string of the field sequential digital image signals 138. The field sequential signal generating apparatus 137 rearranges the bit string in the frame time-period 102 as the bit string in the plurality of (here, four) subframe time-periods 103 in the sequence of R, G, B, and G.

These field sequential digital image signals 138 (DOj) latched in the latch 123 are converted into the analogue image signals AOj sequentially in the sequence of R, G, B, and G from the 1st row within each frame, then being provided to the display unit 126. Here, as an example, the explanation will be given below concerning the conversion of the field sequential digital image signals 138 in the j-th column (DOj).

Namely, first, the digital image signal DORj1 in the 1st row of the field sequential digital image signal for red DORj (FIG. 7A) is converted into a driving signal R for red (i.e., AOj1) in synchronization with the frame timing signal Sf and the subframe timing signal (the reading timing signal of the digital image signal in the 1st row DORj1) SP1 at a point in time t50 and the row timing signal SP4 at a point in time t501 (t50=t501). Then, the driving signal R is applied as a driving voltage for red VDj1 (FIG. 7B) to a pixel in the j-th column and the 1st row. Subsequently, the image signal DORj2 in the 2nd row is converted into a driving signal R for red (i.e., AOj2) in synchronization with the row timing signal SP4 at a point in time t502, then being applied as a driving voltage for red VDj2 to a pixel in the j-th column and the 2nd row.

In this way, the image signals DORj are sequentially converted into the driving signals AOj. Finally, the image signal DORjn in the n-th row is converted into a driving signal R for red (i.e., AOjn) in synchronization with the row timing signal SP4 at a point in time t5On, then being applied as a driving voltage for red VDjn (FIG. 7C) to a pixel in the j-th column and the n-th row.

Next, in much the same way, the digital image signal DOGj1 in the 1st row of the field sequential digital image signal for green DOGj (FIG. 7A) is converted into a driving signal G for green (i.e., AOj1) in synchronization with the subframe timing signal (the reading timing signal of the digital image signal in the 1st row DORj1) SP1 at a point in time t51 and the row timing signal SP4 at a point in time t511 (t51=t511). Then, the driving signal G is applied as a driving voltage for green VDj1 (FIG. 7B) to the pixel in the j-th column and the 1st row. In this way, the image signals DOGj are sequentially converted into the driving signals AOJ. Finally, the Image signal DOGjn in the n-th row is converted into a driving signal G for green (i.e., AOjn) in synchronization with the row timing signal SP4 at a point in time t51n, then being applied as a driving voltage for green VDjn (FIG. 7C) to the pixel in the j-th column and the n-th row. In much the same way, the field sequential digital image signals for blue DOBj are converted into the driving signals AOj, then being applied as driving voltages for blue. The polarity of each of the driving signals AOj generated in this way is inverted for each subframe time-period in response to the subframe timing signals SP1 (FIG. 7E) that function as subframe polarity inverting signals as well.

Figures 7A, 7B, 7C, 7D, 7E, 7F, 7G:
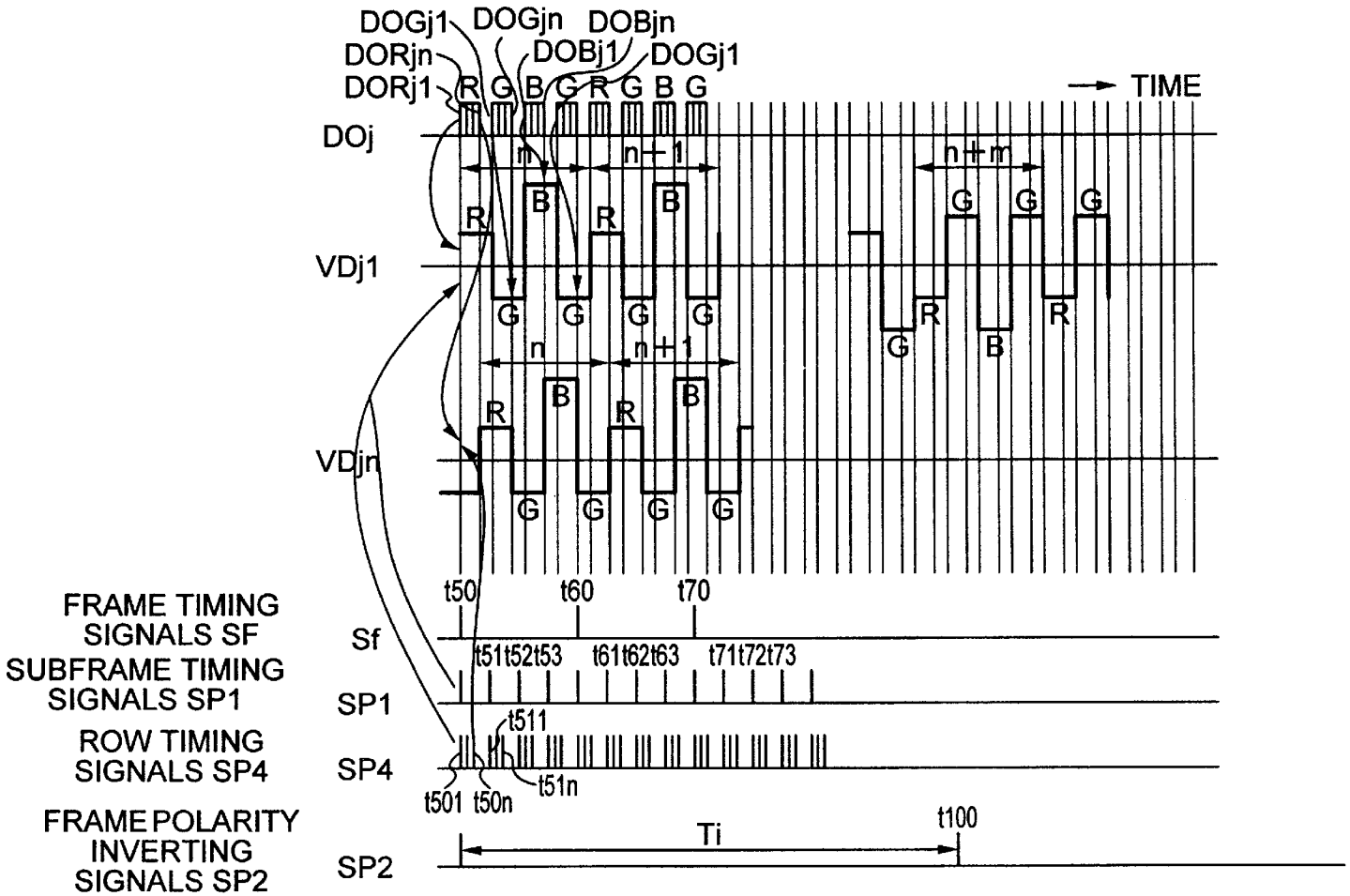
FIGS. 7A to 7G are timing charts for illustrating examples of signal waveforms of the respective portions for explaining operations of a latch and a D/A converter in the 1st embodiment of the liquid crystal display apparatus.

Furthermore, the polarity of each of the driving signals AOj generated in this way is inverted on a fixed length of time Ti (a plurality of frame time-periods) basis in response to the frame polarity inverting signals SP2 (FIG. 7G). In the illustrated example, the polarity of each of the driving signals AOj is inverted at points in time t50, t100.

(2nd Embodiment)

Next, the explanation will be given below regarding the 2nd embodiment of the present invention.

Figures 8A, 8B:
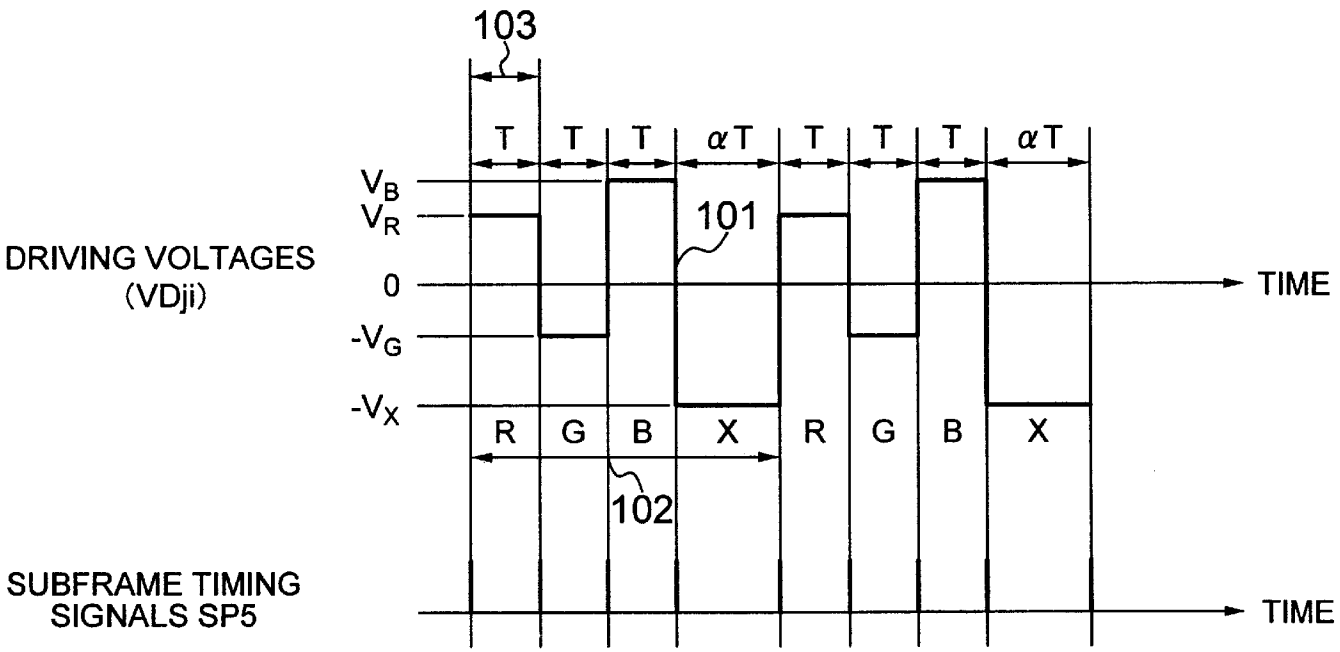
FIGS. 8A, 8B are diagrams for illustrating data such as signal waveforms of driving voltages in a color field sequential driving method in the 2nd embodiment of the present invention.

FIGS. 8A, 8B are diagrams for illustrating signal waveforms for explaining the principle of a liquid crystal driving method in the 2nd embodiment. FIG. 8A illustrates a driving voltage waveform in the 2nd embodiment. FIG. 8B illustrates the subframe timing signals in the 2nd embodiment.

A driving voltage waveform 101 to a liquid crystal pixel illustrated in FIG. 8A (VDji: a driving voltage waveform to an arbitrary pixel in the j-th column and the i-th row), as is the case with the 1st embodiment, has a periodic structure the fundamental period of which is a frame time-period 102. Each of the frame time-periods 102 further includes a plurality of (2s, s is an integer equal to or larger than 2) shorter and finer subframe time-periods 103. The driving voltage waveform 101 to the 1st column (AO1) is generated in synchronization with subframe timing signals SP5 illustrated in FIG. 8B.

The present embodiment is characterized by the following configuration: Within one frame, in addition to the three subframes during which the driving voltage for each of the colors of R, G, B is applied to a pixel, there exists a voltage correcting subframe X for applying a correcting voltage to the pixel. At the same time, the one frame is configured to include even number (in the illustrated example, four)of subframes including the voltage correcting subframe X. By employing this configuration, as is the case with the 1st embodiment, even if the driving voltage is the continuous rectangular wave-shaped or square wave-shaped voltage, a polarity of the driving voltage for each color remains one and the same polarity in each frame. Furthermore, the existence of the voltage correcting subframe X makes it possible to eliminate the direct voltage component the elimination of which has been impossible in the 1st embodiment.

In this way, in the present embodiment, a time-sequential arrangement of the driving voltages for the 2s (s is an integer equal to or larger than 2) monochromatic images that include the three primary colors of red, blue, and green is employed as one unit. Then, the one unit of arrangement of the driving voltages is sequentially applied periodically to each of the pixels included in the display unit so as to cause each of the pixels to sequentially display the monochromatic images arranged in accordance with the arrangement, wherein the driving voltage for the monochromatic image is caused to be any one of the driving voltages for red, blue, and green, and the 1st driving voltage (correcting voltage), the driving voltage being applied at one point in time to each of the pixels included in the display unit.

Incidentally, in this case, during the subframe time-period X, the voltage is applied to the liquid crystal pixel although it is the correcting voltage for eliminating the direct voltage component. As a result, the pixel is driven, and at this time, if light is launched into the pixel, the light passes therethrough or is shielded thereby. This causes the pixel to be recognized as an image. Accordingly, in this time-period, it is required at least to prevent the pixel from being irradiated with the light from a light source or to prevent an observer from visually recognizing the light that has passed through the pixel (In the present specification, from a sense that the liquid crystal is being driven, this state is also referred to as the monochromatic image).

Figure 9A:
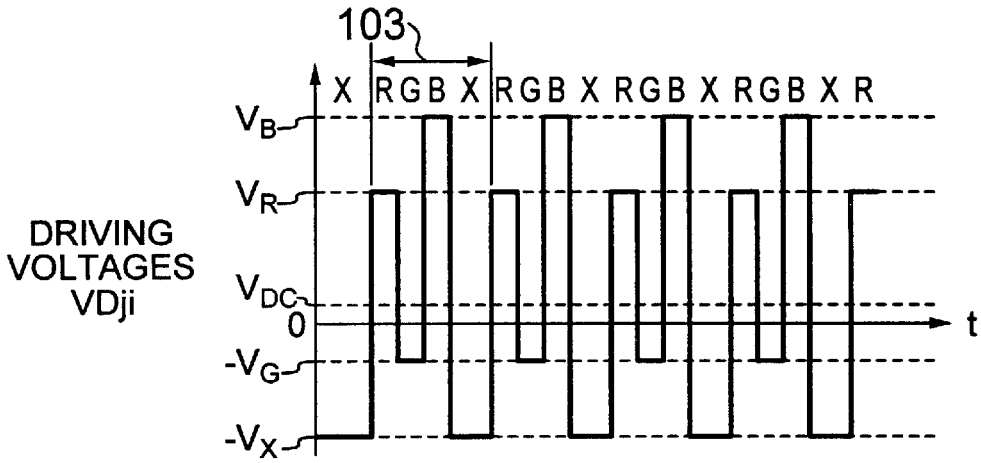
FIGS. 9A to 9C are diagrams for illustrating data such as signal waveforms of driving voltages in the color field sequential driving method in the 2nd embodiment of the present invention.
Figure 9B:
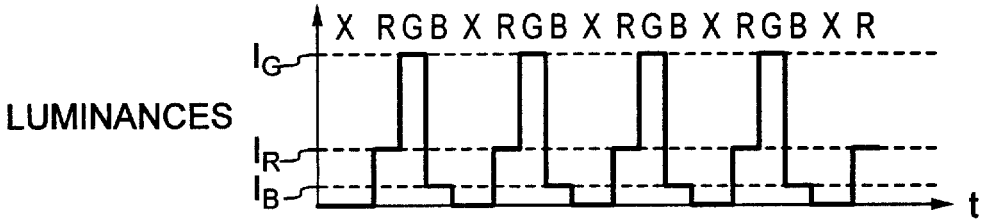
Figure 9C:
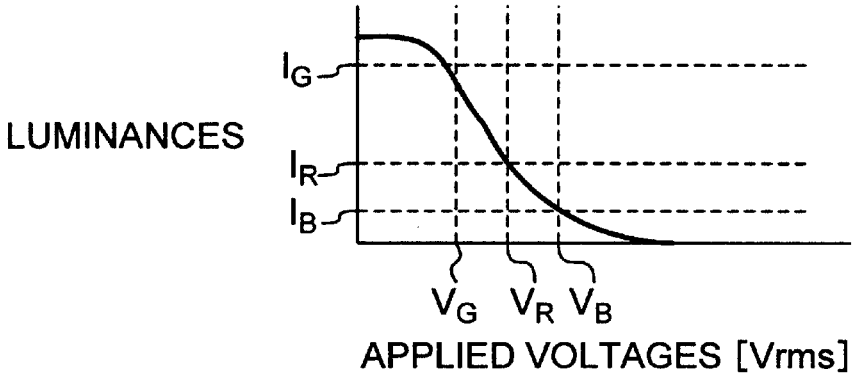

FIGS. 9A to 9C are diagrams for explaining in detail the principle of the present embodiment illustrated in FIG. 8A. FIGS. 9A to 9C illustrate the following, respectively: FIG. 9A: time variations in the waveforms of the driving voltages (VDji) applied to a certain one liquid crystal pixel, FIG. 9B: time variations in luminances of the liquid crystal pixel in the case where the driving voltages in FIG. 9A are applied to the liquid crystal pixel, FIG. 9C: the relationship between the applied voltages to the pixel and the luminances of the pixel (i.e., the dependence of the luminances on the applied voltages). In the present embodiment, the correcting voltage is applied during the one subframe time-period X within each frame time-period, thereby making it possible to eliminate the direct voltage component for each frame time-period. Hereinafter, the explanation will be given concerning the correcting voltage $V_X$ of this kind.

The direct voltage component $V_{DC}$ of the driving voltages (VDji) in a certain frame time-period is determined by the following formula (formula (1)), using $V_R$,$V_G$,$V_B$, i.e., the pixel driving voltages in the respective subframe time-periods for displaying each of the colors of R, G, B within the frame time-period. Incidentally, here, the driving voltages $V_R$,$V_G$, $V_B$ are of values defined with $V_{CTR}$ employed as the reference voltage. This formula formulates the direct voltage component caused by the rectangular wave-shaped or square wave-shaped driving voltages.

$$V_{DC}=V_R+V_G+V_B \tag{1}$$

Consequently, in the voltage correcting subframe time-period X within the frame time-period, by applying the correcting voltage $V_X$(formula (2)) the magnitude and the polarity of which are the same as and opposite to the magnitude and the polarity of the direct voltage component $V_{DC}$, respectively, it becomes possible to eliminate the direct voltage component.

$$V_X=-V_{DC}=-(V_R+V_G+V_B) \tag{2}$$

However, there are some cases where, depending on conditions of the voltage application of $V_R$, $V_G$,$V_B$, an absolute value of the correcting voltage $V_X$ becomes larger than absolute values of the driving voltages for displaying the respective colors of R, G, B (Namely, the absolute value of $V_X$ becomes larger than any one of the absolute values of $V_R$,$V_G$,$V_B$). The present configuration presents no problems when there exists a sufficiently large allowance in the withstand voltage characteristic of a driving element in the driving circuit. However, in the case where the correcting voltage becomes larger than $V_{max}$, i.e., a maximum drivable voltage in the driving element, the present configuration is unable to eliminate the direct voltage component completely. Accordingly, including the correcting voltage as well, a voltage of the driving element needs to be smaller than $V_{max}$, i.e., the maximum drivable voltage in the driving element. In that case, it is possible to implement this condition by changing a time-width of the subframe X. Assuming that each of the subframe time-periods corresponding to the driving voltages for displaying the respective colors of R, G, B is a fixed length of time T, the time-width of the voltage correcting subframe time-period X is αT, and the maximum applicable voltage and a minimum applicable voltage in the driving element are $V_{max}$, $V_{min}$, respectively, α is defined by the following formula (3):

$$\alpha = 2 - \frac{V_{\min}}{V_{\max}} \tag{3}$$

Figure 9D:
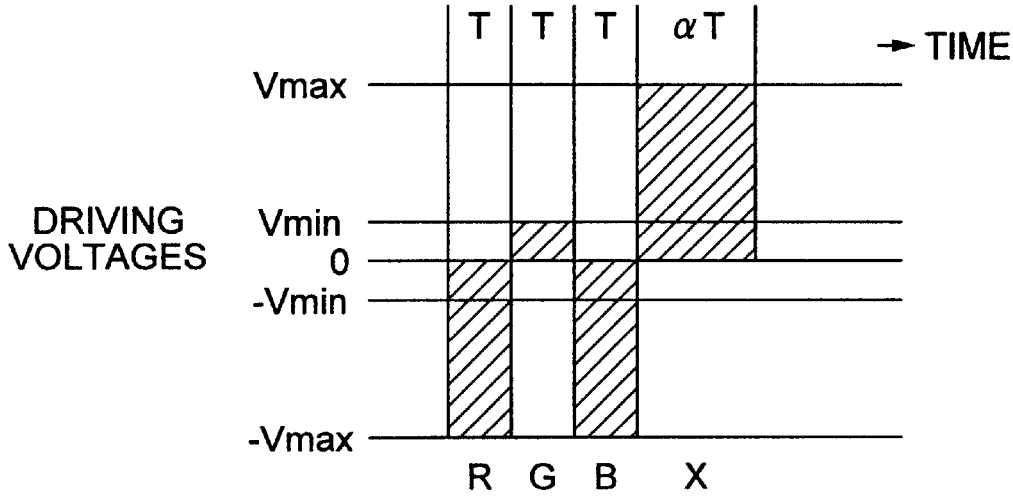
FIG. 9D is a diagram for illustrating a signal waveform of a driving voltage for explaining a correcting voltage in the color field sequential driving method in the 2nd embodiment of the present invention.

Here, referring to the waveforms of the driving voltages within one frame illustrated in FIG. 9D, the explanation will be given below concerning the reason why α is defined by the formula (3). First, as illustrated in FIG. 9D, $V_G$ and $V_X$ exhibit one polarity and $V_R$ and $V_B$ exhibit the other polarity. The condition on which $V_X$ becomes its maximum is that, at the time when $|V_G|=V_{min}$ and $|V_R|=|V_B|=V_{max}$, $|V_X|=V_{max}$. Thus, assuming that the time-width of the subframe X is α times the time-width T of the other subframe time-periods, from the condition that the direct voltage component becomes equal to 0, the following formula is obtained:

$$|V_R|+|V_B|=|V_G|+\alpha|V_X|$$

Namely, $$V_{max}+V_{max}=V_{min}+\alpha V_{max}$$

Thus, α is given as follows:

$$\alpha=2-V_{min}/V_{max}.$$

Also, the correcting voltage $V_X$ is given by the following formula (4):

$$V_X = -\frac{(V_R + V_G + V_B)}{\alpha} \tag{4}$$

Consequently, in the present embodiment, the one frame time-period becomes equal to (3+α)T. Additionally, as explained above, when there exists the allowance in the withstand voltage characteristic of the driving element, setting as $\alpha=1$ is well enough. When there exists further allowance, setting as even $\alpha \geqq 1$ is possible. As a concrete method, the following method is also allowable: In the subframe X, after writing the correcting voltage $V_X$ with the time-period T that is the same as the time-period of the other subframes, the correcting voltage $V_X$ is further applied during a holding time-period of $(\alpha-1)T$, thereby making the entire application time of the correcting voltage $V_X$ equal to $\alpha T$.

The above-described calculations such as the correcting voltage $V_X$ are made on the assumption that the liquid crystal driving voltage waveforms are of the ideal rectangular wave or square wave. In the actual element, however, there exists the following problem: While applying the voltage to the pixels, a resistance component of the liquid crystal reduces or gradually decrease with a lapse of time the voltage applied actually between the pixels. Namely, none of he driving voltages becomes of the complete rectangular wave or square wave. Accordingly, it is required to take into consideration the influence of a voltage holding ratio of the liquid crystal. In the case where the value of $\alpha$ of the subframe X is equal to 1, since the influences of the voltage holding ratio can be considered to be relatively the same, it is considered that there exist no serious problem. However, in the case where the value of $\alpha$ of the subframe X is larger than 1, i.e., in the case where the subframe time-period X is longer than the other subframe time-periods, electric charges become more likely to be accumulated between the electrodes. As a result, a RMS value of the applied voltage is varied a little more greatly as compared with the cases of the other subframe time-periods. On account of this, when the voltage holding ratio is low, it is required to design the actual value of $\alpha$ a little more greatly than the value determined by the formula (3). Its correcting value can be determined easily by the experiment. Also, in the case where $\alpha$ is smaller than 1, the correcting voltage is determined in much the same concept and manner as described above.

Additionally, the position relationship in time within one frame between the subframe X and the subframes corresponding to the driving voltages for the respective colors of R, G, B is not limited to the example in FIG. 8A but is changeable. Namely, for example, a sequence such as R, G, X, B is allowable. Also, although, in the example in FIG. 8A, there is provided the one subframe time-period X within the one frame, it is also possible to divide the subframe time-period X into a plurality of time-periods.

Also, in the present embodiment as well, as illustrated in FIG. 2A in the 1st embodiment, it is allowable to invert the polarity of the driving voltage in each subframe on the basis of the certain fixed length of time Ti that is longer than the frame time-period 102. This inversion is effective in eliminating an exceedingly slight amount of direct voltage component that can not be corrected completely by the above-described correcting voltage.

Next, referring to FIG. 10, the explanation will be given below regarding the configurations of a frame memory and a memory controller in the 2nd embodiment. The entire circuit configuration of a liquid crystal display apparatus in the 2nd embodiment is substantially the same as that in the 1st embodiment illustrated in FIG. 4. However, the configurations of the frame memory 122 and the memory controller 121 in the 1st embodiment differ partially as will be explained below. In the following explanation, only the configuration elements differing from those in the 1st embodiment will be explained, and the explanation will be omitted regarding the configuration elements having the same functions.

Figure 10:
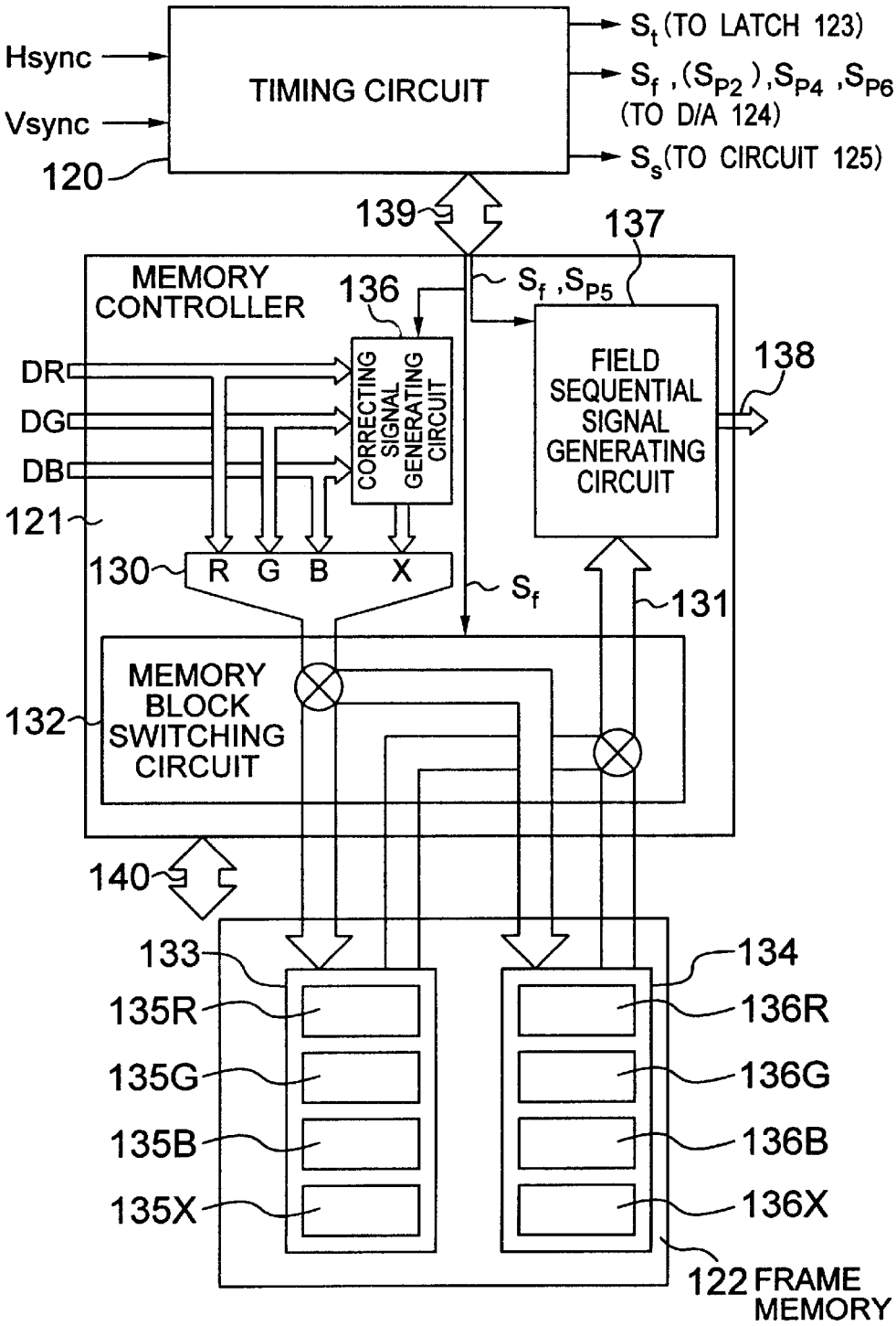
FIG. 10 is a block diagram for illustrating configuration examples of a frame memory and a memory controller in the 2nd embodiment of the liquid crystal display apparatus according to the present invention.

FIG. 10 illustrates an inner configuration example of the frame memory 122 and the memory controller 121 in the 2nd embodiment. The frame memory 122 has a memory capacity for storing at a time the signals by the amount of two frames the one frame of which includes four subframes where one correcting voltage signal is added to the digital image signals for the three colors of R, G, B, i.e., the signals by the amount of eight subframes in total. In the present embodiment, the frame memory 122 has the 1st frame memory block 133 and the 2nd frame memory block 134 that each store the signals in a unit of one frame. The frame memory block 133 and the frame memory block 134 has subframe memory blocks 135R, 135G, 135B, 135X and 136R, 136G, 136B, 136X that store the digital image signals DR, DG, DB in the subframe time-periods for red, green, and blue, and the correcting voltage $V_X$, respectively. As is the case with the 1st embodiment, in response to the frame timing signal Sf, the memory block switching circuit 132 switches, for each frame, between the frame memory block into which the signals are written and the frame memory block from which the signals are read.

The digital image signals DR, DG, DB for R, G, B are stored into the frame memory 122 by way of the bus 130 and the memory block switching circuit 132 and at the same time, the digital image signals DR, DG, DB are inputted into a correcting signal generating circuit 136. The correcting signal generating circuit 136 generates the correcting voltage $V_X$ in synchronization with the frame timing signal Sf, based on the inputted digital image signals DR, DG, DB for R, G, B, for each pixel, for each frame, and in accordance with the above-described formula (4). Namely, the correcting signal generating circuit 136 generates, for each frame, digital image data in the voltage correcting subframe time-period X within the frame, then storing the digital image data into the frame memory 122 by way of the memory block switching circuit 132. Incidentally, $\alpha$ has been determined and set into the correcting signal generating circuit 136 in advance.

Figures 11A, 11B, 11C, 11D, 11E:
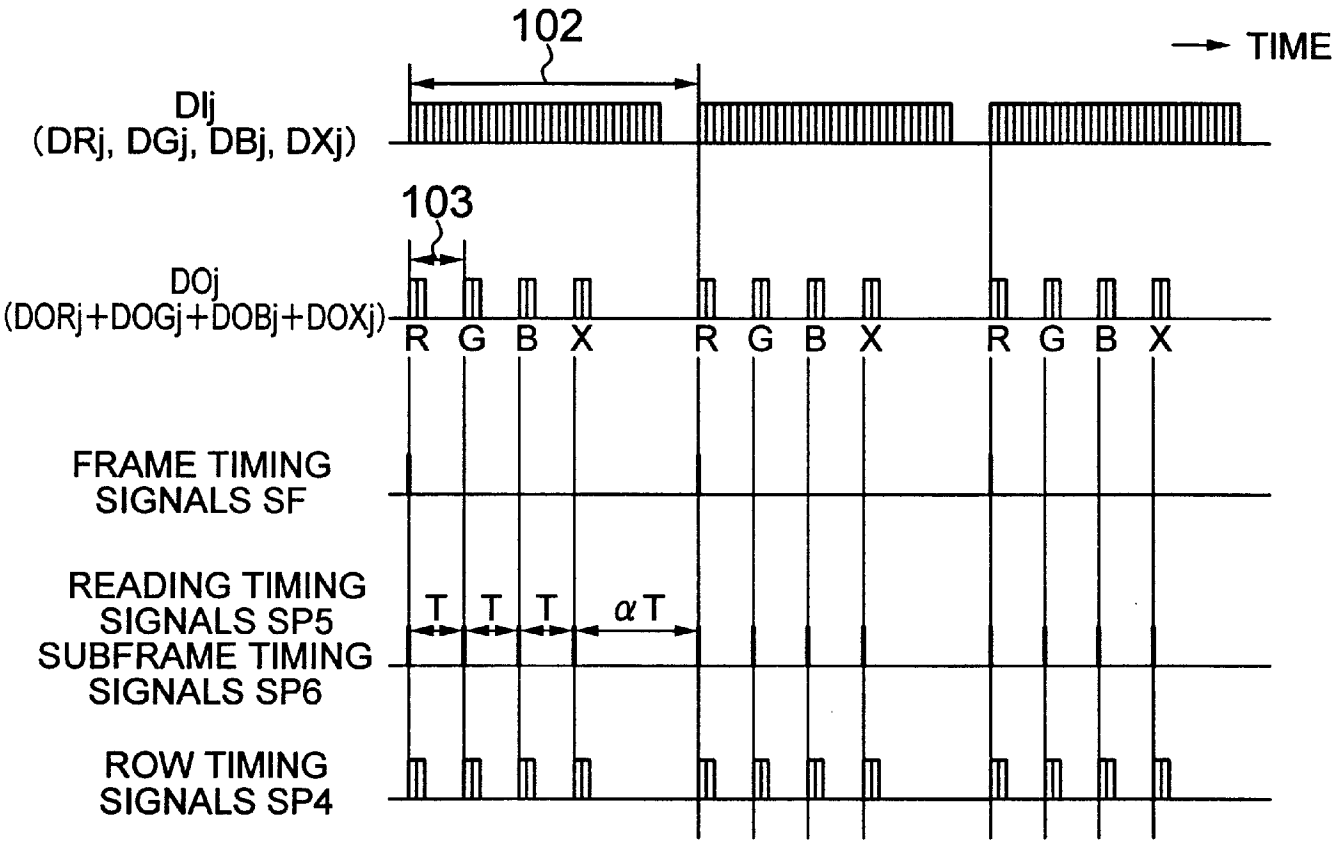
FIGS. 11A to 11E are diagrams for illustrating data such as signal waveforms of driving voltages in the color field sequential driving method in the 2nd embodiment of the present invention.

FIGS. 11A to 11E illustrate the digital image signals and various types of timing signals in the present embodiment, and the transverse axis represents time. A signal DIj illustrated in FIG. 11A represents a bit string in the j-th ($m \geqq j \geqq 1$) column of any arbitrary one of the digital image signals DR, DG, DB for R, G, B and the correcting voltage signal DX stored into the frame memory 122. Here, the correcting voltage signal DX is a signal determined for each pixel. A signal DOi illustrated in FIG. 11B is a bit string of the field sequential digital image signals 138 for each color in the j-th column (DOj, $m \geqq j \geqq 1$: DORJ+DOGj+DOBj+DOXJ) generated by the field sequential signal generating circuit 137. Namely, the bit string in the one frame time-period 102 is rearranged by the field sequential signal generating apparatus 137 as the bit string in the plurality of subframe time-periods 103 in the sequence of R, G, B, and X. The respective subframe time-periods for the colors of R, G, B in each frame are equal to each other, whereas the voltage correcting subframe time-period X is set to be a times the respective subframe time-periods.

Namely, in synchronization with frame timing signals Sf (FIG. 11C) and reading timing signals SP5 (FIG. 11D: which are synchronized with subframe timing signals SP6 illustrated in FIG. 11D) generated by the timing circuit 120, the field sequential signal generating circuit 137 reads, from the frame memory 122, the digital image signals DRj, DGj, DBj and the correcting voltage signal DXJ in each column. Then, the generating circuit generates the field sequential digital image signals 138 for each color in the j-th column (DOj, m≧j≧1: DORj+DOGJ+DOBj+DOXj) in the sequence of R, G, B, and X, thus outputting the digital image signals to the latch 123. Namely, the field sequential digital image signals 138 including field sequential digital image signals DO1 in the 1st column to field sequential digital image signals DOm in the m-th column are provided to the latch 123 in parallel.

In synchronization with the frame timing signals Sf, the subframe timing signals SP6, and row timing signals SP4, these field sequential digital image signals 138 (DOj) latched in the latch 123 are converted into the analogue image signals AOj sequentially in the sequence of R, G, B, G and X from the 1st row within each frame. Moreover, the analogue image signals are provided to the display unit 126, then being applied to the corresponding pixels as the driving voltages VDj.

Incidentally, the polarity of each of the driving signals AOj generated in this way is inverted for each subframe time-period in response to the subframe timing signals SP5 (FIG. 8B) that function as the subframe polarity inverting signals as well.

Additionally, as described earlier, in the present embodiment as well, the polarity of each of the generated driving signals AOj is allowed to be inverted on the fixed length of time Ti (a plurality of frame time-periods) basis in synchronization with the frame polarity inverting signals SP2 (FIG. 7G).

(3rd Embodiment)

Next, the explanation will be given below concerning the 3rd embodiment of the present invention.

FIGS. 12A to 12G illustrate driving voltage waveforms for explaining the principle of a liquid crystal driving method in the 3rd embodiment.

In any of FIGS. 12A to 12G, the transverse axis represents time and the longitudinal axis represents driving voltages, and each of driving voltage waveforms 101 represents a driving voltage applied to a liquid crystal pixel in correspondence with an image signal. In the present embodiment, as is the case with the 1st embodiment, one frame includes even number of (2s, s is an integer equal to or larger than 2) subframes. The present embodiment, however, is characterized by a configuration where RMS driving voltages in subframes for displaying at least one of the three primary colors exhibit one and the same polarity within an arbitrary frame. Hereinafter, the concrete explanation will be given regarding the driving voltages.

In any of FIGS. 12A to 12G, one frame includes, for example, eight subframes, and the sequence of the colors within the respective frames also remains the same. In addition, two subframes for displaying a certain color, i.e., for example, green exhibit one and the same polarity (here, a positive polarity) within the frame and within an arbitrary frame. In contrast to this, driving voltages in subframes for displaying the other two colors (i.e., R, B) do not always exhibit one and the same polarity within one frame. FIGS. 12A to 12G define and present variety types of polarities of the driving voltages in the subframes for displaying R, B.

In the present embodiment, the configuration is employed where only the driving voltages for displaying green are set to exhibit one and the same polarity within one frame. The reason for this setting is as follows: In general, if the spectral luminous sensitivity differs, the frequency characteristic with which a flicker is perceived differs. In particular, in the color of green, the spectral luminous sensitivity is high and the flicker is visually recognized with a frequency lower than that of the other colors. In this sense, it can be said that the present embodiment belongs to a higher-order concept of the 1st embodiment.

However, in the present method, as is the case with the 1st embodiment, it is also undeniable that the direct voltage component can not be eliminated and remains as a problem. Accordingly, just like the 1st embodiment, it is possible to aim to reduce the direct voltage component by inverting the entire polarities on a certain fixed length of time (a predetermined frame) basis. In the present embodiment, however, instead of employing such a method, the following new method of reducing the direct voltage component is employed:

First, the description will be given regarding the principle of the new method of reducing the direct voltage component. The direct voltage component in one frame time-period is represented by a time average value of the driving voltages in the one frame time-period (the driving voltage value per unit time in the one frame time-period). Accordingly, the calculations are performed for the respective pixels concerning the time average value of the driving voltages in one frame time-period 102 so as to employ a condition corresponding to the smallest of absolute values of the calculation results, thereby making it possible to eliminate the direct voltage component. The respective conditions mean, as will be explained next, specific combinations of polarities of the driving voltages in the respective subframes for displaying R, B.

Next, the explanation will be given below regarding the details of such combinations. As described earlier, the driving voltages for displaying green are set to always exhibit the positive polarity and the driving voltages for displaying the other two colors are set to exhibit the positive polarity or a negative polarity. As a result, it is appropriate enough to consider various cases of conditions about the six subframes for displaying R, B (i.e., three subframes for R, three subframes for B). Based on the permutations, the number of the combinations of polarities in the six subframes for displaying R, B can be considered to be the sixth power of 2=64 in total. However, since there exist the three subframes for R, B, respectively, the permutations about this are excluded and in addition, out of the resultant combinations, the combinations unable to take the minimum values are excluded. This operation results in 12 conditional formulae indicated by formulae (5) concerning the respective time average values of the driving voltages. As one example of this, the drawings corresponding to (i) to (vii) of the formulae (5) are illustrated in FIGS. 12A to 12G, respectively.

$$2V_G+3V_R-V_B \quad \text{(i)}$$

$$2V_G+3V_R-3V_B \quad \text{(ii)}$$

$$2V_G+V_R-V_B \quad \text{(iii)}$$

$$2V_G+V_R-3V_B \quad \text{(iv)}$$

$$2V_G-V_R-V_B \quad \text{(v)}$$

$$2V_G-V_R-3V_B \quad \text{(vi)}$$

$$2V_G-3V_R-3V_B \quad \text{(vii)}$$

$$2V_G+3V_B-V \quad \text{(viii)}$$

$$2V_G+3V_B-3V_R \quad \text{(ix)}$$

$$2V_G+V_B-V_R \quad \text{(x)}$$

$$2V_G+V_B-V_R \quad \text{(xi)}$$

$$2V_G-V_B-3V_R \quad \text{(xii) (5)}$$

Consequently, based on the inputted digital image signals DR, DG, DB, for each pixel, and for each frame, the calculations of the above-described formulae (i) to (vii) are performed, respectively, so as to employ the formula satisfying the condition that, as described above, the time average value of the driving voltages in one frame becomes the minimum (Namely, the formula on which the calculation result becomes the minimum value), thereby making it possible to eliminate the direct voltage component.

Next, referring to FIG. 13, the explanation will be given below regarding the configurations of a frame memory and a memory controller in the 3rd embodiment. The entire circuit configuration of a liquid crystal display apparatus in the 3rd embodiment is substantially the same as that in the 1st embodiment illustrated in FIG. 4. However, the configurations of the frame memory 122 and the memory controller 121 in the 1st embodiment differ partially as will be explained below. In the following explanation, only the configuration elements differing from those in the 1st embodiment will be explained, and the explanation will be omitted regarding the configuration elements having the same functions.

Figure 13:
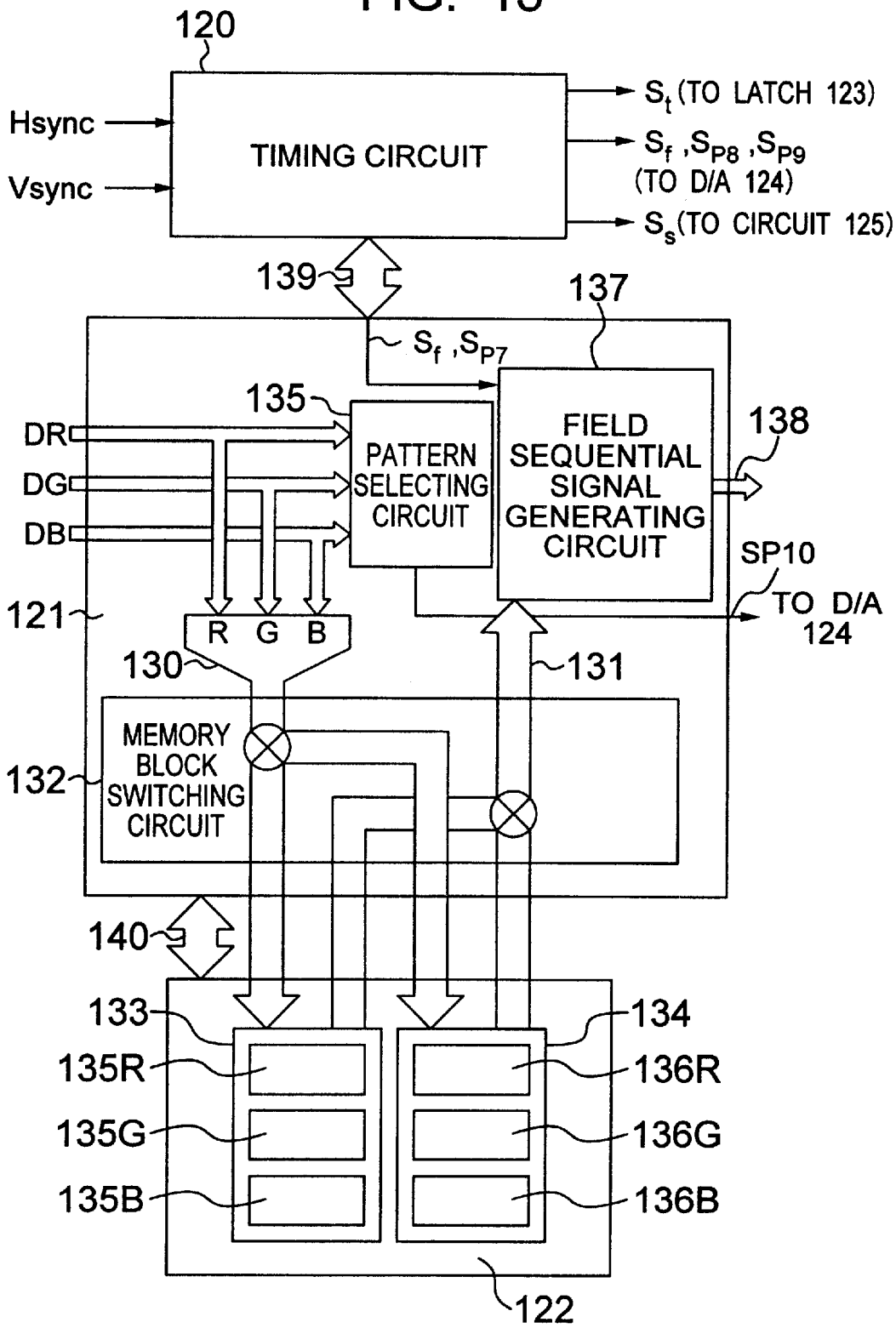
FIG. 13 is a block diagram for illustrating configuration examples of a frame memory and a memory controller in the 3rd embodiment.

FIG. 13 illustrates an inner configuration example of the frame memory 122 and the memory controller 121 in the 3rd embodiment. The frame memory 122 has a memory capacity for storing at a time the signals by the amount of two frames the one frame of which includes three subframes including the digital image signals for the three colors, i.e., the signals by the amount of six subframes in total. As is the case with the 1st embodiment, in response to the frame timing signal Sf, the memory block switching circuit 132 switches, for each frame, between the frame memory block into which the signals are written and the frame memory block from which the signals are read.

Figures 12A, 12B, 12C, 12D, 12E, 12F, 12G, 12H:
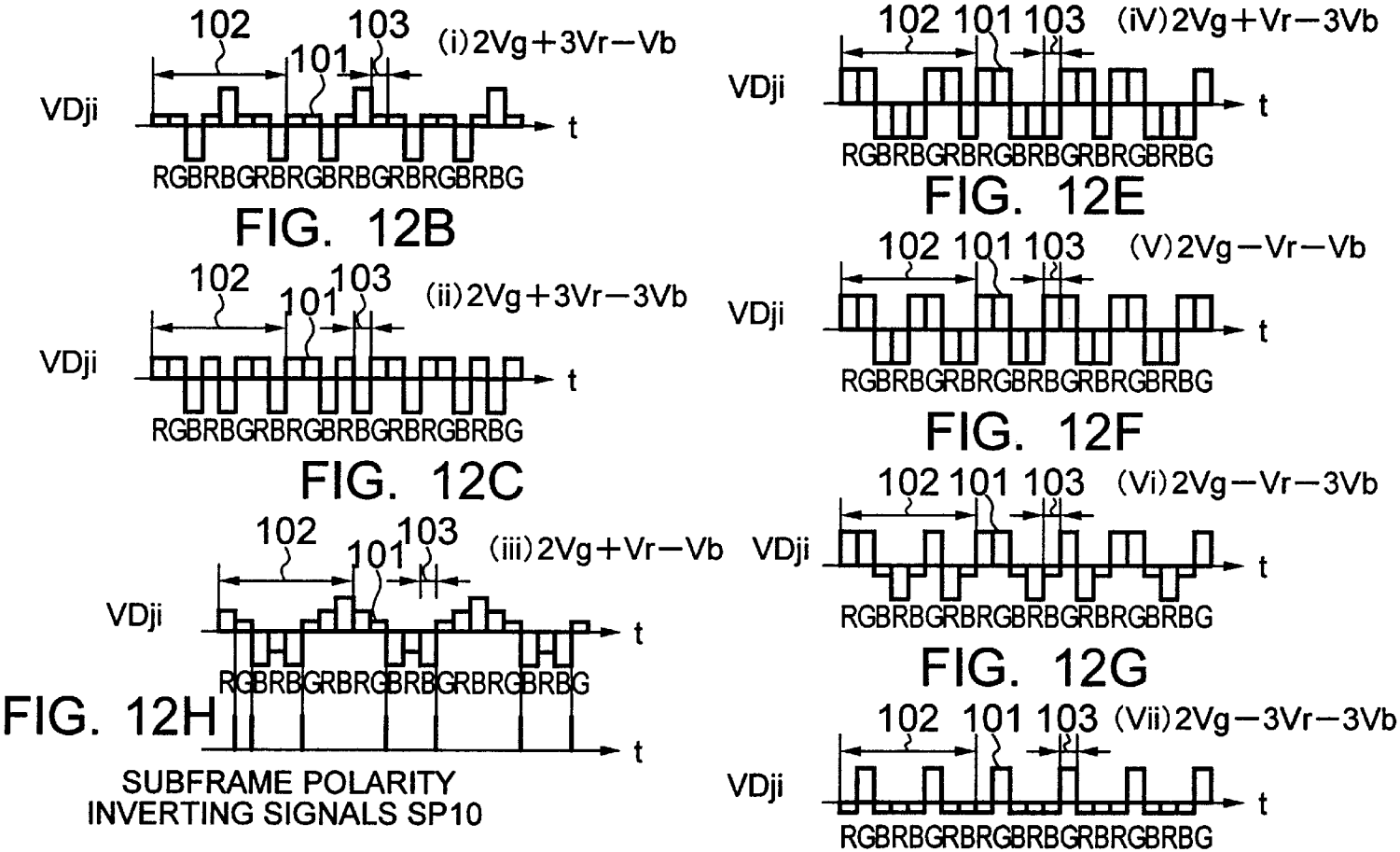
FIGS. 12A to 12G are diagrams for illustrating driving voltage waveforms for explaining the principle of a liquid crystal driving method in the 3rd embodiment of the present invention.
FIG. 12H is a diagram illustrating a subframe polarity inverting signals.

The digital image signals DR, DG, DB for R, G, B are stored into the frame memory 122 by way of the bus 130 and the memory block switching circuit 132 and at the same time, the digital image signals DR, DG, DB are inputted into a pattern selecting circuit 135. In synchronization with the frame signal Sf, based on the inputted digital image signals DR, DG, DB, for each pixel, and for each frame, the pattern selecting circuit 135 performs the calculations of the above-described formulae (i) to (vii), respectively, thereby judging as described above the formula satisfying the condition of the minimum value (Namely, the formula on which the calculation result of the time average value of the driving voltages for one frame becomes the minimum value). Then, the pattern selecting circuit 135 provides, to the D/A circuit 124, the subframe polarity inverting signals SP10 corresponding to the judgement result. Here, assuming that the formula satisfying the condition of the minimum value towards a certain pixel is, for example, the formula (iii) (which corresponds to FIG. 12C), a signal illustrated in FIG. 12H is outputted as the subframe polarity inverting signal SP10.

Based on the digital image signals DR, DG, DB for R, G, B read from the frame memory 122, for each pixel, and in accordance with the judgement result from the pattern selecting circuit 135 (Namely, the formula on which the calculation result becomes the minimum value), the field sequential signal generating apparatus 137 rearranges the digital image signals DR, DG, DB for R, G, B, then outputting them as a bit string.

Figures 14A, 14B:
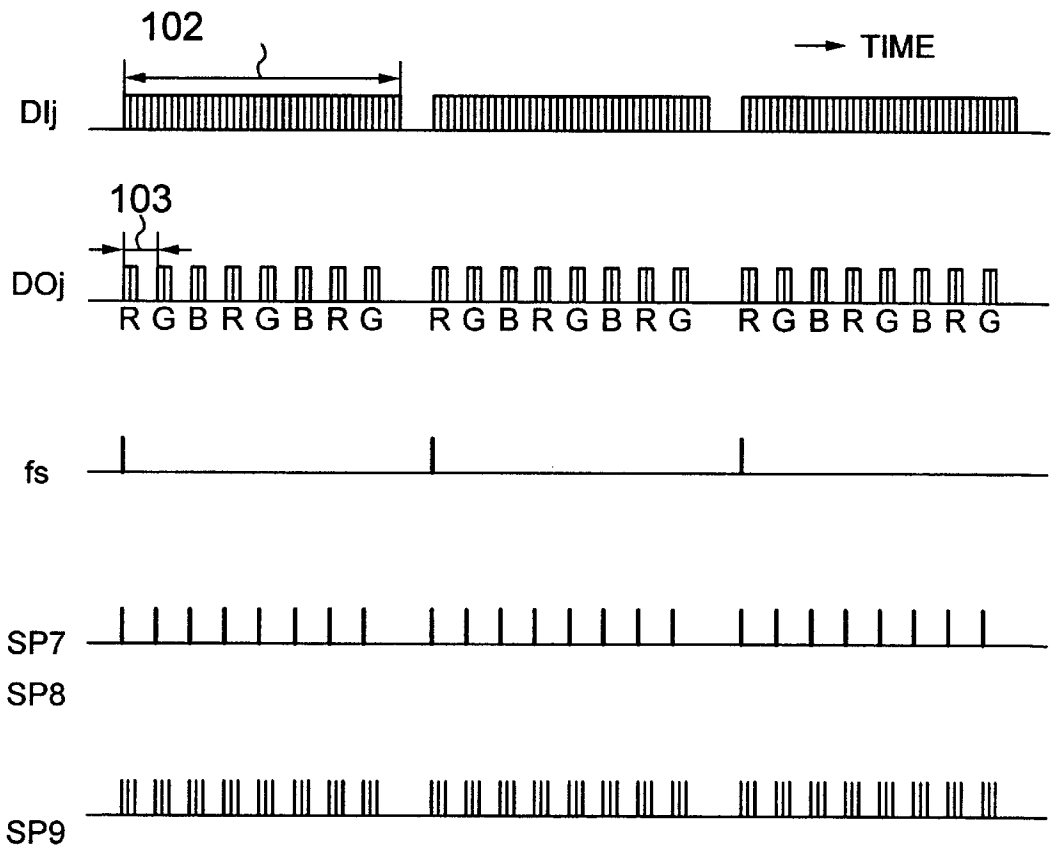

FIGS. 14A to 14E illustrate the digital image signals and various types of timing signals in the present embodiment, and the transverse axis represents time. A signal DIJ illustrated in FIG. 14A represents a bit string in the j-th ($m \geqq j \geqq 1$) column of any arbitrary one of the digital image signals DR, DG, DB for R, G, B stored into the frame memory 122. A signal DOi illustrated in FIG. 14B is a bit string of the field sequential digital image signals 138 in the j-th column (DOj, $m \geqq j \geqq 1$: DORj+DOGj+DOBJ+DORJ+DOBj+DOGj+DORj+DOBj) generated by the field sequential signal generating circuit 137. Namely, the bit string in each frame time-period 102 is rearranged by the field sequential signal generating apparatus 137 as the bit string in the eight subframe time-periods 103 in the sequence of R, G, B, R, B, G, R, and B. The respective subframe time-periods for R, G, B, R, B, G, R, B in each frame are equal to each other.

Namely, in synchronization with frame timing signals Sf (FIG. 14C) and reading timing signals SP7 (FIG. 14D: which are synchronized with subframe timing signals SP8 illustrated in FIG. 14D) generated by the timing circuit 120, the field sequential signal generating circuit 137 reads, from the frame memory 122, the digital image signals DRJ, DGj, DBJ in each column. Then, the generating circuit generates the field sequential digital image signals 138 for each color (DOj, $m \geqq j \geqq 1$: DORJ+DOGj+DOBJ+DORJ+DOBj+DOGj+DORj+DOBj) in the sequence of R, G, B, R, B, G, R, and B, thus outputting the digital image signals to the latch 123. Namely, the field sequential digital image signals 138 including field sequential digital image signals DO1 in the 1st column to field sequential digital image signals DOm in the m-th column are provided to the latch 123 in parallel.

In synchronization with the frame timing signals Sf, the subframe timing signals SP8, and row timing signals SP9 (FIG. 14E) from the timing circuit 120, and in synchronization with the subframe polarity inverting signal SP10 from the pattern selecting circuit 139, these field sequential digital image signals 138 (DOj) latched in the latch 123 are inverted in the polarities, then being converted into the analogue image signals AOj sequentially in the sequence of R, G, B, R, B, G, R, and B within one frame. Moreover, the analogue image signals are provided to the display unit 126, thus being applied to the corresponding pixels as the driving voltages so as to be displayed.

Also, in the present embodiment, it is effective to employ a configuration where the time average value of the driving voltages in each frame becomes a positive minimum value and a negative minimum value for each of one or more frames alternately.

Incidentally, although, in the present embodiment, the description has been given regarding the example where the one frame includes the eight subframes, the method in the present embodiment can easily be extended and applied to the cases where the number of the subframes is smaller or larger than eight. Also, a variety of combinations can be considered concerning the sequence of displaying the colors of R, G, B, and thus the sequence is not limited to that of the present embodiment. Also, although, in the present embodiment, only the driving voltage for green is set to always exhibit one and the same polarity, it is also possible to employ a configuration where driving voltages for two or more colors out of the colors of red, blue, and green always exhibit one and the same polarity. In this case, since green has the highest luminous sensitivity, from the viewpoint of preventing the flicker, it is the most effective to set the voltage for green to always exhibit one and the same polarity. Accordingly, in the case as well where the voltages for the two or more colors out of red, blue, and green are set to always exhibit one and the same polarity, it is preferable to employ a configuration where either of the voltage for green and the voltage for red or blue always exhibits one and the same polarity.

Incidentally, also here, regarding the number of the subframes, the sequence of the colors, and the driving voltage for a color to always exhibit one and the same polarity, one example has been given and thus they are not limited to those of the present embodiment.

The point in the present embodiment is as follows: Concerning a color the luminous efficiency of which is high, i.e., the color in which the flicker is recognized even if the frequency is comparatively low, the driving voltage for the color is set to always exhibit one and the same polarity. Moreover, regarding a color the luminous efficiency of which is low, i.e., the color in which the flicker is difficult to recognize even if the frequency is comparatively high, the condition of a polarity of the driving voltage is classified depending on the cases, the calculations are performed, and a condition allowing the minimum value to be obtained is employed, thereby eliminating the direct voltage component.

(4th Embodiment)

Figure 15:
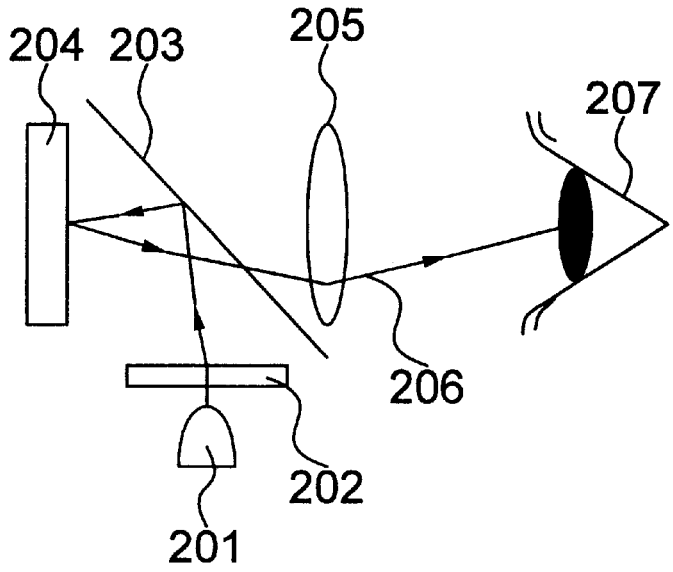
FIG. 15 is a diagram for illustrating a wearable display apparatus using the liquid crystal display apparatus in the 1st, the 2nd, or the 3rd embodiment.

FIG. 15 is a diagram for illustrating an embodiment of a wearable display apparatus using the liquid crystal display apparatus in the 1st, the 2nd, or the 3rd embodiment.

The present apparatus includes light sources 201, a diffuser 202, a polarization beam splitter 203, the liquid crystal display apparatus 204 (a portion of the liquid crystal display apparatus other than the light source unit included in the driving unit) described in the 1st, the 2nd, or the 3rd embodiment illustrated in FIG. 4, and a magnification lens 205. These configuration components 201, 202, 203, 205 are equivalent to the light source unit included in the driving unit. Hereinafter, the operation principle of the present apparatus will be explained.

First, the diffuser 202 diffuses a light emitted from the one or two light sources 201. As the light sources, for example, a light emitting diode and the like is preferable. Then, the display unit 126 in the liquid crystal display apparatus 204 is irradiated with the diffused light through the polarization beam splitter 203. Moreover, the reflected light 206 from the display unit 126 passes through the polarization beam splitter 203, attaining to an observer 207 through the magnification lens 205.

The employment of the liquid crystal display apparatus described in the 1st, the 2nd, or the 3rd embodiment makes it possible to implement the wearable display that is capable of displaying a high picture-quality image exhibiting no flicker.

(5th Embodiment)

FIGS. 16, 17A, 17B, 18A, and 18B are diagrams for illustrating an embodiment of a light source used when performing an image display according to the color field sequential driving method.

Figure 16:
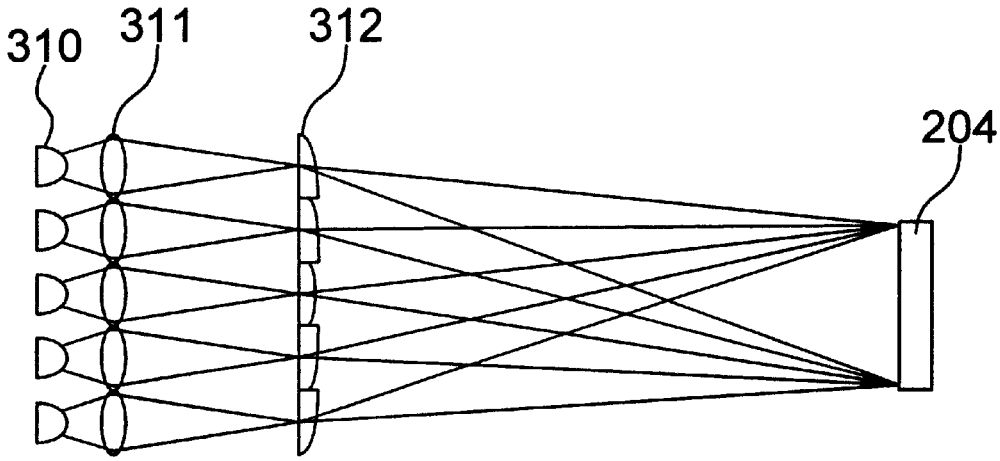
FIG. 16 is a diagram for illustrating an example of a light source used when performing an image display according to the color field sequential driving method in the present invention.

First, the explanation will be given concerning FIG. 16. A light source in the present embodiment includes a plurality of light emitting diodes 310 located in an array-like configuration, the first lens array 311 including a plurality of first lenses located in one-to-one correspondence with the respective light emitting diodes 310, and the second lens array 312 including a plurality of second lenses located in one-to-one correspondence with the respective light emitting diodes 310. Lights emitted from the respective light emitting diodes are gathered by the first lens array 311 being in one-to-one correspondence with the respective light emitting diodes. Then, the second lens array 312 irradiates with the gathered light the entire display unit 126 in the liquid crystal display apparatus 204. This makes it possible to obtain the light source having a uniform irradiation intensity distribution on the liquid crystal display apparatus 204.

Figure 17A:
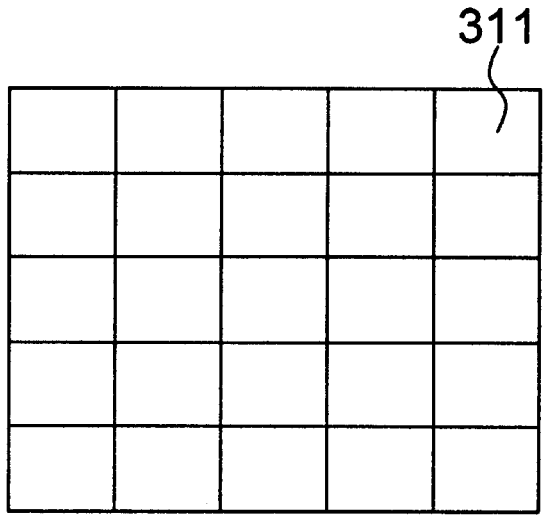
FIGS. 17A, 17B are front views for illustrating a lens array used in the light source in the present invention.
Figure 17B:
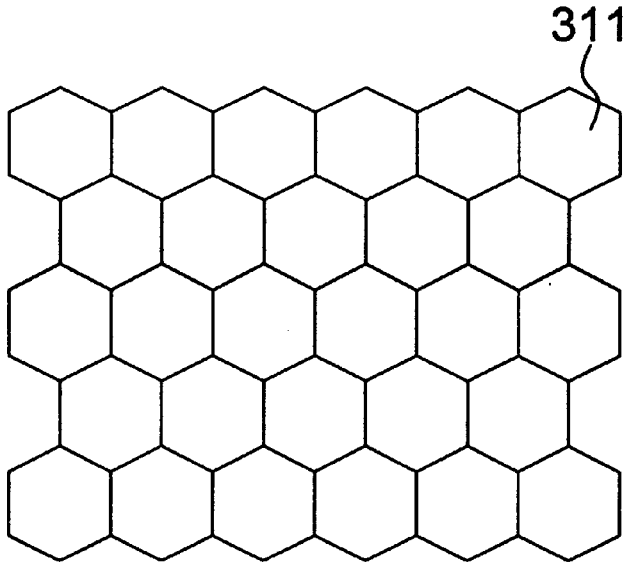

FIGS. 17A, 17B are front views of the first lens array 311. FIG. 17A illustrates the case where rectangle-shaped lenses are located in a matrix-like configuration, and FIG. 17B illustrates the case where hexagon-shaped lenses are located in a honeycomb-like configuration. Although these drawings illustrate the rectangle-shaped and hexagon-shaped lens arrays, the configurations of the lens arrays are not limited thereto and the configurations such as triangle-shaped and circle-shaped configurations are also allowable. In the present embodiment, the rectangle-shaped and hexagon-shaped configurations are mentioned just as examples of locating the lenses effectively. Accordingly, the other configurations are allowable as long as they are capable of accomplishing the same effects.

Figure 18A:
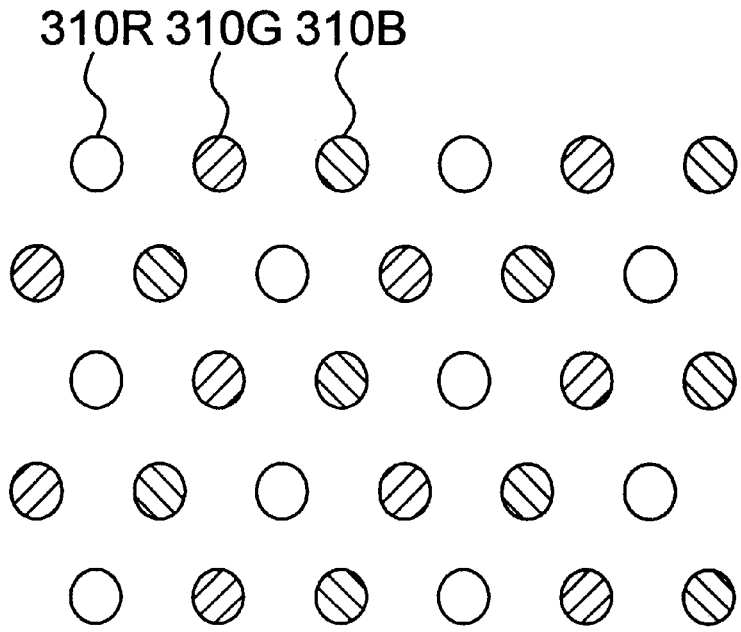
FIGS. 18A, 18B are explanatory diagrams for explaining the lens array used in the light source in the present invention.
Figure 18B:
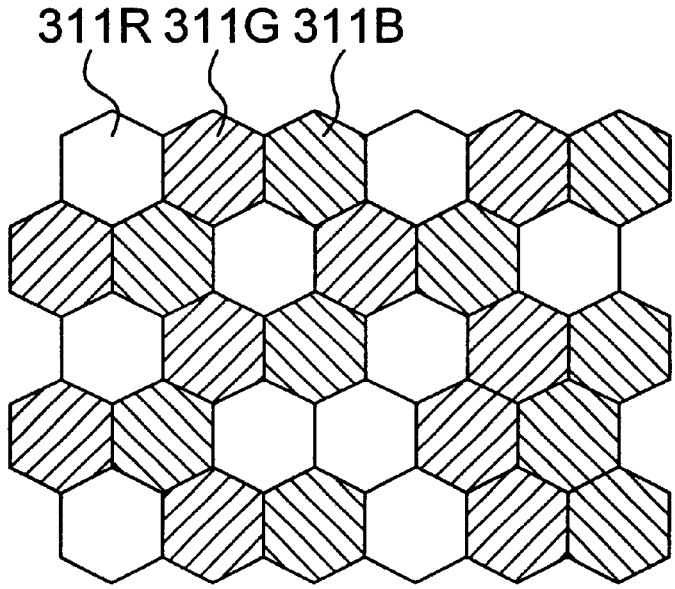

FIGS. 18A, 18B are explanatory diagrams for explaining the light emitting diodes 310 and the first lens array 311 corresponding thereto. FIG. 18A illustrates the light emitting diodes 310 located in the array-like configuration, and FIG. 18B illustrates the first lens array 311 located in correspondence with the light emitting diodes 310. Incidentally, FIG. 18B illustrates an example of the location of the first lens array 311 in FIG. 17B.

In FIG. 18A, the respective light emitting diodes are independently located as point light sources, respectively. As described earlier, the lights emitted from the respective light emitting diodes are extended over the entire screen by the first and the second lens arrays, thus having the uniform irradiation intensity distribution. Consequently, when the lights emitted from the respective light emitting diodes are superimposed, the superimposed light also has the uniform irradiation intensity distribution on the liquid crystal display apparatus 204.

In the present embodiment, the position relationship of the colors of the respective light emitting diodes is set to be a regular arrangement (a sequence of R, G, B from the left to the right). Even when the position relationship of the colors is set to be a random arrangement, as long as the first and the second lens arrays correspond to the respective light emitting diodes, the liquid crystal display apparatus 204 is uniformly irradiated with the lights emitted from the respective light emitting diodes. Accordingly, even if the respective lights are superimposed, it is possible to obtain the uniform irradiation intensity distribution. Consequently, the position regulation of the colors of the respective light emitting diodes is not limited to that of the present embodiment. Also, although the monochromatic light emitting diodes are used in the present embodiment, it is also allowable to use a module in which three chips are implemented in one package. In this case, it is possible to increase the number of the light emitting diodes per unit area, which allows the luminance to be enhanced. Additionally, although, in the present embodiment, the explanation has been given regarding the light emitting diodes, the implementation is possible as long as the light sources are the ones that are usable as the point light sources. An organic EL can be mentioned as an example of such type of light sources.

(6th Embodiment)

Figure 19:
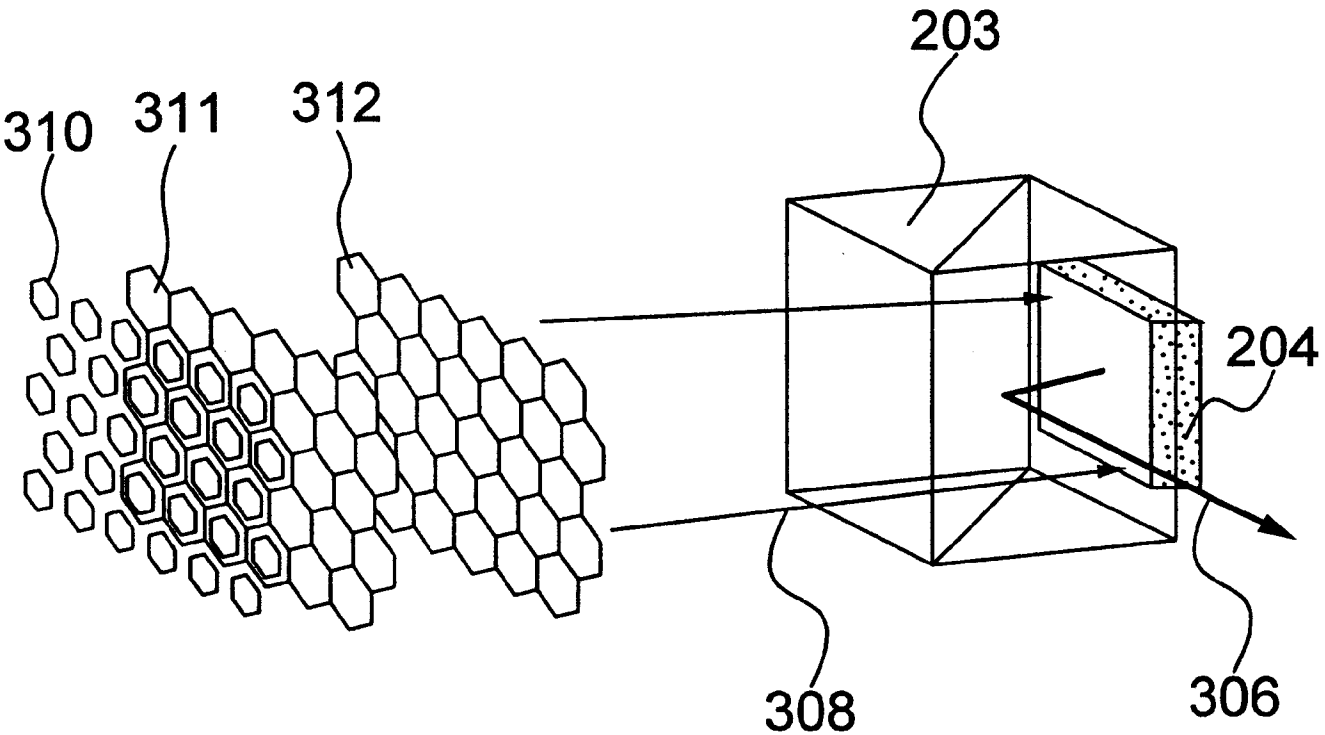
FIG. 19 is a diagram for illustrating an embodiment of a projector using the light source in FIGS. 16 to 18B.

FIG. 19 is an explanatory diagram for explaining an embodiment of a projector using the light source in the 5th Embodiment. In the present embodiment, there is provided a polarization beam splitter 203 that functions as follows: The splitter permits the light from the second lens array 312 in the 5th Embodiment to pass through, and causes the display unit 126 to be irradiated with the light that has passed through the splitter. Moreover, the splitter deflects the reflected light 206 from the display unit, thereby causing the reflected light to attain to an observer. In this way, since the light emitting diodes 310 are used as the color field sequential light source, it is well enough to lit up the respective diodes only at necessary points in time. This condition results in none of the light loss caused by the color filter, thus making it possible to aim to implement the projector with a low power consumption.

(7th Embodiment)

Figure 20A:
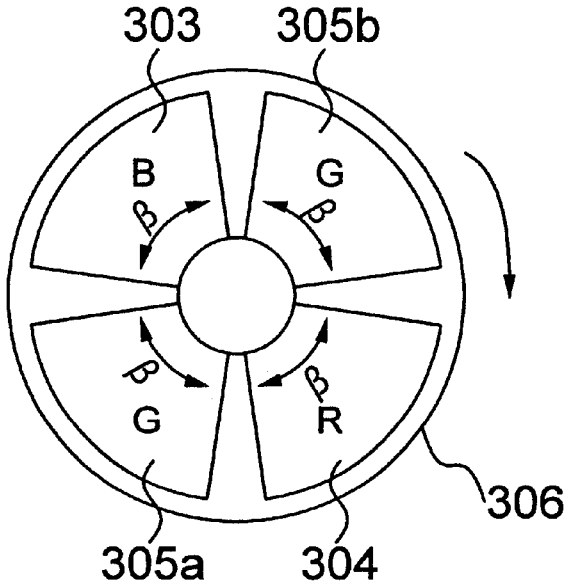
FIGS. 20A, 20B are diagrams for illustrating embodiments of a color wheel that becomes required in the case where the light source used when performing an image display in the color field sequential driving method is a light source of white light.
Figure 20B:
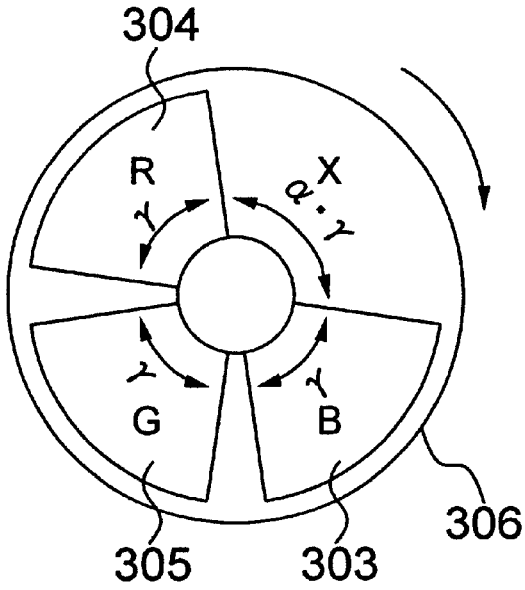

FIGS. 20A, 20B are diagrams for illustrating embodiments of a color wheel that becomes required in the case where the light source used when performing an image display in the color field sequential driving method is a light source of white light.

FIG. 20A illustrates a color wheel 306 in the 1st embodiment, and FIG. 20B illustrates a color wheel 306 in the 2nd embodiment.

The explanation will be given below regarding FIG. 20A. In the 1st embodiment, there are provided two subframe time-periods for displaying, for example, G within one frame time-period. Accordingly, as illustrated in the drawing, there are provided one color filter 303 for B, one color filter 304 for R, and two color filters for G, i.e., four color filters in total.

In the 1st embodiment, the respective subframe time-periods for the colors of R, G, B, G within one frame time-period are equal to each other. Accordingly, when rotating the color wheel 306 at a constant rotation speed, the angles of arcs of the respective arc-shaped color filters 303, 304, 305*a*, 305*b* for B, R, G, G must be made equal to $\beta$, respectively. This is needed to equate the times that it takes the respective lights of R, G, B, G within one frame to pass through the color filters.

The explanation will be given below regarding FIG. 20B. In the color field sequential driving method in the 2nd embodiment, there exists the voltage correcting subframe time-period X within one frame. Accordingly, as described earlier, in the voltage correcting subframe time-period, it is required at least to prevent the pixel from being irradiated with the light from the light source or to prevent an observer from visually recognizing the light emitted from the pixel. Consequently, in the present embodiment, a region for shielding the irradiation light is provided in the color wheel 306. Also since the time-width of the subframe time-period X is different from that of the other subframe time-period for displaying any one of the colors of R, G, B, the angle of the region for shielding the irradiation light is set in such a manner as to be different from the angles of the color filters. Then, in trying to rotate the color wheel 306 at the constant rotation speed, in the embodiment of the color wheel illustrated in FIG. 20B, the angles of arcs of the respective arc-shaped color filters 303, 304, 305 for B, R, G must be made equal to $\gamma$, respectively. Furthermore, the angle of an arc of the arc-shaped region X for shielding the irradiation light is set to be $\alpha\gamma$.

Consequently, when $\alpha$ in the 2nd embodiment is larger than 1, i.e., when the voltage correcting subframe time-period X is longer than the other subframe time-period for displaying any one of the colors of R, G, B, it is required to make the angle of the shielding region larger than the angles of the color filters. Meanwhile, when $\alpha$ is smaller than 1, i.e., when the voltage correcting subframe time-period X is shorter than the other subframe time-period for displaying any one of the colors of R, G, B, it is required to make the angle of the shielding region smaller than the angles of the color filters. This is because, when the rotation speed is constant, a time that it takes the irradiation light to pass through a color filter is proportional to the angle of the color filter.

The color wheel illustrated in FIG. 20A or FIG. 20B is an embodiment where a time needed for the one rotation is equal to one frame time-period. Of course, it is also allowable to employ a configuration where the number of the division of the color wheel is increased so that the time needed for the one rotation of the color wheel becomes equal to n frame time-periods.

Furthermore, since the position relationship in which the color filters are located corresponds to the sequences of the colors in the 1st and the 2nd embodiments, the location is not limited to those of these embodiments.

(8th Embodiment)

Figure 21:
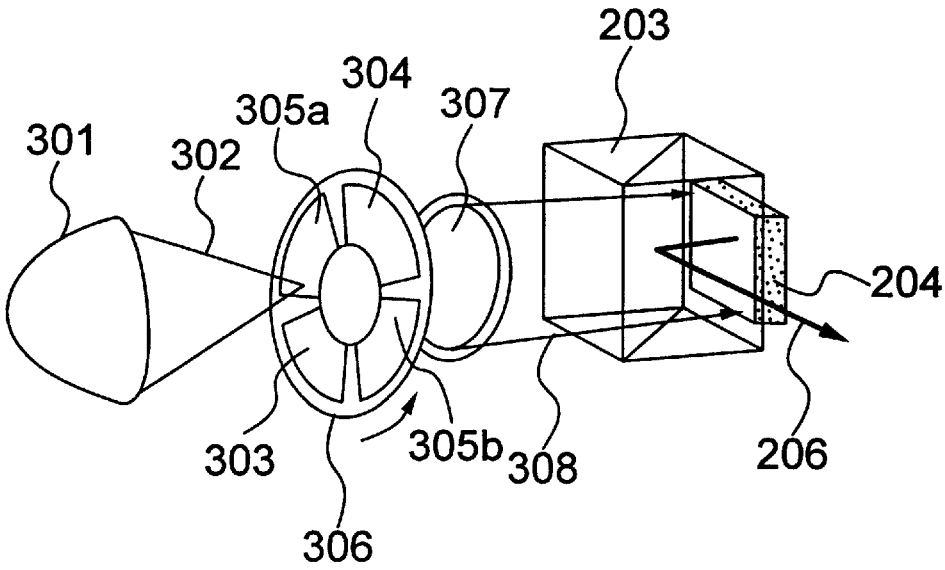
FIG. 21 is a diagram for illustrating an embodiment of a projection type display apparatus using a light source in FIGS. 20A, 20B.

FIG. 21 is a diagram for illustrating an embodiment of a projection type display apparatus using the light source in the 7th Embodiment.

The present apparatus includes a light source 301, the color wheel 306 illustrated in FIG. 20A or FIG. 20B, a collimator lens 307, a polarization beam splitter 203, and the liquid crystal display apparatus 204. Hereinafter, the operation principle thereof will be explained briefly.

First, the color wheel 306 is irradiated with a light emitted from the light source. The light with which the color wheel 306 is irradiated is resolved in colors as described in the 7th Embodiment. After that, the resolved light is launched into the collimator lens 307, and the liquid crystal display apparatus 204 is irradiated with the launched light through the polarization beam splitter 203. An image light 206 modulated by the liquid crystal display apparatus 204 is projected onto the screen through the polarization beam splitter 203 again, thereby displaying the image. The employment of the liquid crystal display apparatus in the 1st or the 2nd embodiment makes it possible to implement the projection type display that is capable of displaying a high picture-quality image exhibiting no flicker.

As having been described so far, according to the present invention, it becomes possible to implement the liquid crystal display apparatus that displays the high picture-quality image exhibiting no flicker.

What is claimed is:

1. A liquid crystal display apparatus, comprising:

a display unit including a plurality of pixels; and a driving unit for sequentially applying a driving voltage for displaying a monochromatic image to each of said plurality of pixels included in said display unit so as to cause each of said pixels to sequentially display said monochromatic image;

wherein said driving unit:

employs, as one unit, a time-sequential arrangement of driving voltages for displaying said 2s (s is an integer equal to or larger than 2) monochromatic images that include three primary colors of red, blue, and green, and sequentially applies said arrangement of said driving voltages of said one unit periodically to each of said pixels included in said display unit so as to cause each of said pixels to sequentially display said monochromatic images arranged in accordance with said arrangement;

wherein said driving voltage for displaying said monochromatic image to be applied at one point in time to each of said pixels included in said display unit is one of said driving voltages for red, blue, and green so that a color of said monochromatic image is one of said three primary colors of red, blue, and green;

wherein each of said pixels included in said display unit is caused to display said monochromatic image at one point in time; and wherein said driving unit causes said each arrangement of said driving voltages of said one unit to include, in addition to said driving voltages for displaying said three primary colors of red, blue, and green, at least one of said driving voltages for displaying said monochromatic images of a specified one and the same color out of said three primary colors of red, blue, and green, and at least two of said driving voltages for displaying said monochromatic images of said specified one and the same color applied with the same polarity so as to prevent occurrence of flicker.

2. A liquid crystal display apparatus according to claim 1, wherein said driving unit causes a polarity of said driving voltage to be inverted for each of said sequentially displayed monochromatic images, said driving voltage being applied to said each pixel; and wherein, in said each one unit of arrangement of said driving voltages, said driving unit causes at least two of said driving voltages for displaying said monochromatic images of said specified one and the same color to be located in positions where said two of said driving voltages exhibit one and the same polarity.

3. A liquid crystal display apparatus according to claim 2, wherein said driving unit causes a voltage polarity of said arrangement of said driving voltages of said one unit to be inverted every a plurality of said arrangements of said driving voltages of said one unit, said arrangement being sequentially applied to said each pixel.

4. A liquid crystal display apparatus according to claim 1, wherein, in accordance with a color field sequential driving method, said driving unit:

sequentially applies said driving voltage for displaying said monochromatic image to each of said plurality of pixels so as to cause said each pixel to sequentially display said monochromatic image, and applies said driving voltages to said each pixel in a one-frame unit as said arrangement of said driving voltages of said one unit.

5. A liquid crystal display apparatus according to claim 1, wherein said driving unit arbitrarily controls a polarity of said driving voltage for each of said sequentially displayed monochromatic images, said driving voltage being applied to said each pixel; and wherein said driving unit causes at least two of said driving voltages for displaying said monochromatic images of said specified one and the same color to exhibit one and the same polarity.

6. A liquid crystal display apparatus according to claim 1, wherein said driving unit includes a light source unit including:

a light source;

a diffuser for diffusing a light emitted from said light source;

a polarization beam splitter for deflecting said light diffused by said diffuser so as to irradiate said display unit with said light and so as to permit a reflected light to pass through, said reflected light being reflected from said display unit; and a magnification lens for permitting said light to transmit through, said light having passed through said polarization beam splitter.

7. A liquid crystal display apparatus according to claim 5, wherein said driving unit includes a light source unit including:

a light source;

a diffuser for diffusing a light emitted from said light source;

a polarization beam splitter for deflecting said light diffused by said diffuser so as to irradiate said display unit with said light and so as to permit a reflected light to pass through, said reflected light being reflected from said display unit; and a magnification lens for permitting said light to transmit through, said light having passed through said polarization beam splitter.

8. A liquid crystal display apparatus, comprising:

a display unit including a plurality of pixels; and a driving unit for sequentially applying a driving voltage for displaying a monochromatic image to each of said plurality of pixels included in said display unit so as to cause each of said pixels to sequentially display said monochromatic image;

wherein said driving unit:

employs, as one unit, a time-sequential arrangement of driving voltages for displaying said 2s (s is an integer equal to or larger than 2) monochromatic images that include three primary colors of red, blue, and green, and sequentially applies said arrangement of said driving voltages of said one unit periodically to each of said pixels included in said display unit so as to cause each of said pixels to sequentially display said monochromatic images arranged in accordance with said arrangement;

wherein a color of said monochromatic image is anyone of said three primary colors of red, blue, and green;

wherein each of said pixels included in said display unit is caused to display said monochromatic image at one point in time;

wherein said driving unit causes said each arrangement of said driving voltages of said one unit to include, in addition to said driving voltages for displaying said three primary colors of red, blue, and green, at least one of said driving voltages for displaying said monochromatic images of a specified one and the same color out of said three primary colors of red, blue, and green;

wherein said driving unit arbitrarily controls a polarity of said driving voltage for each of said sequentially displayed monochromatic images, said driving voltage being applied to said each pixel;

wherein said driving unit causes at least two of said driving voltages for displaying said monochromatic images of said specified one and the same color to exhibit one and the same polarity; and wherein said driving unit determines a polarity of said each driving voltage in said arrangement of said driving voltages of said one unit so that a time average value of said driving voltages in said arrangement of said driving voltages of said one unit becomes the smallest.

9. A liquid crystal display apparatus according to claim 8, wherein said driving unit causes a polarity to be inverted every at least one of said arrangements of said driving voltages of said one unit, said polarity being a polarity of said minimum of said time average value of said driving voltages in said arrangement of said driving voltages of said one unit.

10. A liquid crystal display apparatus, comprising:

a display unit including a plurality of pixels; and a driving unit for sequentially applying a driving voltage for displaying a monochromatic image to each of said plurality of pixels included in said display unit so as to cause each of said pixels to sequentially display said monochromatic image;

wherein said driving unit:

employs, as one unit, a time-sequential arrangement of driving voltages for displaying said 2s (s is an integer equal to or larger than 2) monochromatic images that include three primary colors of red, blue, and green, and sequentially applies said arrangement of said driving voltages of said one unit periodically to each of said pixels included in said display unit so as to cause each of said pixels to sequentially display said monochromatic images arranged in accordance with said arrangement;

wherein a color of said monochromatic image is anyone of said three primary colors of red, blue, and green;

wherein each of said pixels included in said display unit is caused to display said monochromatic image at one point in time; and wherein said driving unit includes a light source unit including:

a light emitting diode array including a plurality of light emitting diodes located in a matrix-like configuration;

a first lens array including a plurality of first lenses, said first lenses being located in a matrix-like configuration in one-to-one correspondence with said plurality of light emitting diodes so as to converge lights emitted from said respective light emitting diodes, respectively; and a second lens array including a plurality of second lenses, said second lenses being located in a matrix-like configuration in one-to-one correspondence with said plurality of first lenses so that said second lenses irradiate said display unit with said lights in such a manner that said lights are extended over a specified region and are superimposed on each other, said lights being converged by said first lens array.

11. A liquid crystal display apparatus according to claim 10, wherein said light source unit further includes a polarization beam splitter for permitting said superimposed light to pass through so as to irradiate said display unit with said light and so as to deflect a reflected light from said display unit, said superimposed light being transmitted from said second lens array.

12. A liquid crystal display apparatus, comprising:

a display unit including a plurality of pixels; and a driving unit for sequentially applying a driving voltage for displaying a monochromatic image to each of said plurality of pixels included in said display unit so as to cause each of said pixels to sequentially display said monochromatic image;

wherein said driving unit:

employs, as one unit, a time-sequential arrangement of driving voltages for displaying said 2s (s is an integer equal to or larger than 2) monochromatic images that include three primary colors of red, blue, and green, and sequentially applies said arrangement of said driving voltages of said one unit periodically to each of said pixels included in said display unit so as to cause each of said pixels to sequentially display said monochromatic images arranged in accordance with said arrangement;

wherein a color of said monochromatic image is anyone of said three primary colors of red, blue, and green;

wherein each of said pixels included in said display unit is caused to display said monochromatic image at one point in time;

wherein said driving unit causes said each arrangement of said driving voltages of said one unit to include, in addition to said driving voltages for displaying said three primary colors of red, blue, and green, at least one of said driving voltages for displaying said monochromatic images of a specified one and the same color out of said three primary colors of red, blue, and green;

wherein said driving unit arbitrarily controls a polarity of said driving voltage for each of said sequentially displayed monochromatic images, said driving voltage being applied to said each pixel;

wherein said driving unit causes at least two of said driving voltages for displaying said monochromatic images of said specified one and the same color to exhibit one and the same polarity; and wherein said driving unit includes a light source unit including:

a light emitting diode array including a plurality of light emitting diodes located in a matrix-like configuration;

a first lens array including a plurality of first lenses, said first lenses being located in a matrix-like configuration in one-to-one correspondence with said plurality of light emitting diodes so as to converge lights emitted from said respective light emitting diodes, respectively; and a second lens array including a plurality of second lenses, said second lenses being located in a matrix-like configuration in one-to-one correspondence with said plurality of first lenses so that said second lenses irradiate said display unit with said lights in such a manner that said lights are extended over a specified region and are superimposed on each other, said lights being converged by said first lens array.

13. A liquid crystal display apparatus according to claim 12, wherein said light source unit further includes a polarization beam splitter for permitting said superimposed light to pass through so as to irradiate said display unit with said light and so as to deflect a reflected light from said display unit, said superimposed light being transmitted from said second lens array.

14. A liquid crystal display apparatus, comprising:

a display unit including a plurality of pixels; and a driving unit for sequentially applying a driving voltage for displaying a monochromatic image to each of said plurality of pixels included in said display unit so as to cause each of said pixels to sequentially display said monochromatic image;

wherein said driving unit:

employs, as one unit, a time-sequential arrangement of driving voltages for displaying said 2s (s is an integer equal to or larger than 2) monochromatic images that include three primary colors of red, blue, and green, and sequentially applies said arrangement of said driving voltages of said one unit periodically to each of said pixels included in said display unit so as to cause each of said pixels to sequentially display said monochromatic images arranged in accordance with said arrangement;

wherein a color of said monochromatic image is anyone of said three primary colors of red, blue, and green;

wherein each of said pixels included in said display unit is caused to display said monochromatic image at one point in time;

wherein said driving unit includes a light source unit including:

a light source;

a color wheel irradiated with a light emitted from said light source;

a collimator lens into which said light is launched, said light being resolved in colors by said color wheel; and a polarization beam splitter for permitting a light from said collimator lens to pass through so as to irradiate said display unit with said light and so as to deflect a reflected light from said display unit;

wherein said color wheel includes 2s color filters having corresponding colors and arranged in accordance with said arrangement of said driving voltages of said one unit, said respective 2s color filters being arc-like in shape and angles of said arcs being identical to each other.

15. A liquid crystal display apparatus, comprising:

a display unit including a plurality of pixels; and a driving unit for sequentially applying a driving voltage for displaying a monochromatic image to each of said plurality of pixels included in said display unit so as to cause each of said pixels to sequentially display said monochromatic image;

wherein said driving unit:

employs, as one unit, a time-sequential arrangement of driving voltages for displaying said 2s (s is an integer equal to or larger than 2) monochromatic images that include three primary colors of red, blue, and green, and sequentially applies said arrangement of said driving voltages of said one unit periodically to each of said pixels included in said display unit so as to cause each of said pixels to sequentially display said monochromatic images arranged in accordance with said arrangement;

wherein, in each arrangement of said driving voltages of said one unit, in addition to the three primary colors of red, blue and green, at least one of the three primary colors of red, blue and green is applied at one point in time to each of said pixels included in said display unit in a manner that at least two of said driving voltages of the same color are applied with the same polarity, so as to prevent occurrence of flicker.

16. A liquid crystal display apparatus according to claim 15, wherein said driving unit causes a polarity of said driving voltage to be inverted for each of said sequentially displayed monochromatic images, said driving voltage being applied to said each pixel.

17. A liquid crystal display apparatus according to claim 16, wherein said driving unit causes said each arrangement of said driving voltages of said one unit to include said first driving voltage in addition to said driving voltages for displaying said three primary colors of red, blue, and green; and wherein said first driving voltage is a voltage that, while said voltage is being applied to a pixel, prevents a light from a light source from being launched into said pixel or prevents said light from being visually recognized by an observer.

18. A liquid crystal display apparatus according to claim 17, wherein said driving unit sets said first driving voltage to be a voltage for correcting a direct voltage component of said driving voltages for displaying said three primary colors of red, blue, and green in said arrangement of said driving voltages of said one unit.

19. A liquid crystal display apparatus according to claim 18, wherein said driving unit sets said first driving voltage in said arrangement of said driving voltages of said one unit to be a voltage, an absolute value of said voltage being substantially equal to a summation of said driving voltages for displaying said three primary colors of red, blue, and green in said arrangement of said driving voltages of said one unit and a polarity of said voltage being opposite to that of said summation.

20. A liquid crystal display apparatus according to claim 15, wherein said driving unit includes a light source unit including:

a light source;

a diffuser for diffusing a light emitted from said light source;

a polarization beam splitter for deflecting said light diffused by said diffuser so as to irradiate said display unit with said light and so as to permit a reflected light to pass through, said reflected light being reflected from said display unit; and a magnification lens for permitting said light to transmit through, said light having passed through said polarization beam splitter.

21. A liquid crystal display apparatus according to claim 15, wherein said driving unit includes a light source unit including:

a light source;

a color wheel irradiated with a light emitted from said light source;

a collimator lens into which said light is launched, said light being resolved in colors by said color wheel; and a polarization beam splitter for permitting a light from said collimator lens to pass through so as to irradiate said display unit with said light and so as to deflect a reflected light from said display unit;

wherein said color wheel includes (2s−1) color filters and a light shielding region, said (2s−1) color filters having corresponding colors and being arranged in accordance with said arrangement of said driving voltages of said one unit, said (2s−1) color filters and said light shielding region being arc-like in shape, respectively, and angles of arcs thereof corresponding to an application time-period of said driving voltages for displaying red, blue, and green and an application time-period of said first driving voltage in said arrangement of said driving voltages of said one unit, respectively.

22. A liquid crystal display apparatus, comprising:

a display unit including a plurality of pixels; and a driving unit for sequentially applying a driving voltage for displaying a monochromatic image to each of said plurality of pixels included in said display unit so as to cause each of said pixels to sequentially display said monochromatic image;

wherein said driving unit employs, as one unit, a time-sequential arrangement of said driving voltages for displaying said 2s (s is an integer equal to or larger than 2) monochromatic images that include three primary colors of red, blue, and green, and sequentially applies said arrangement of said driving voltages of said one unit periodically to each of said pixels included in said display unit so as to cause each of said pixels to sequentially display said monochromatic images arranged in accordance with said arrangement;

wherein said driving voltage for displaying said monochromatic image is anyone of said driving voltages for red, blue, and green and a first driving voltage;

wherein said driving voltage is applied at one point in time to each of said pixels included in said display unit;

wherein said driving unit causes a polarity of said driving voltage to be inverted for each of said sequentially displayed monochromatic images, said driving voltage being applied to said each pixel;

wherein said driving unit causes said each arrangement of said driving voltages of said one unit to include said first driving voltage in addition to said driving voltages for displaying said three primary colors of red, blue, and green;

wherein said first driving voltage is a voltage that, while said voltage is being applied to a pixel, prevents a light from a light source from being launched into said pixel or prevents said light from being visually recognized by an observer;

wherein said driving unit sets said first driving voltage to be a voltage for correcting a direct voltage component of said driving voltages for displaying said three primary colors of red, blue, and green in said arrangement of said driving voltages of said one unit;

wherein said driving unit sets said first driving voltage in said arrangement of said driving voltages of said one unit to be a voltage, an absolute value of said voltage being substantially equal to a summation of said driving voltages for displaying said three primary colors of red, blue, and green in said arrangement of said driving voltages of said one unit and a polarity of said voltage being opposite to that of said summation;

wherein said driving unit sets an application time-period of said first driving voltage in said arrangement of said driving voltages of said one unit to be a times an application time-period of said driving voltages for displaying the other respective monochromatic images, said a being equal to $2-V_{min}/V_{max}$ or more; and wherein said driving unit sets said first driving voltage in said arrangement of said driving voltages of said one unit to be a voltage, an absolute value of said voltage being substantially equal to one- $\alpha$th of a summation of said driving voltages for displaying said three primary colors of red, blue, and green in said arrangement of said driving voltages of said one unit and a polarity of said voltage being opposite to that of said summation, $V_{max}$,$V_{min}$ being maximum and minimum voltages applicable to a pixel, respectively.

23. A liquid crystal display apparatus, comprising:

a display unit including a plurality of pixels; and a driving unit for sequentially applying a driving voltage for displaying a monochromatic image to each of said plurality of pixels included in said display unit so as to cause each of said pixels to sequentially display said monochromatic image;

wherein said driving unit:

employs, as one unit, a time-sequential arrangement of said driving voltages for displaying said 2s (s is an integer equal to or larger than 2) monochromatic images that include three primary colors of red, blue, and green, and sequentially applies said arrangement of said driving voltages of said one unit periodically to each of said pixels included in said display unit so as to cause each of said pixels to sequentially display said monochromatic images arranged in accordance with said arrangement;

wherein said driving voltage for displaying said monochromatic image is anyone of said driving voltages for red, blue, and green and a first driving voltage;

wherein said driving voltage is applied at one point in time to each of said pixels included in said display unit; and wherein said driving unit includes a light source unit including:

a light emitting diode array including a plurality of light emitting diodes located in a matrix-like configuration;

a first lens array including a plurality of first lenses, said first lenses being located in a matrix-like configuration in one-to-one correspondence with said plurality of light emitting diodes so as to converge lights emitted from said respective light emitting diodes, respectively; and a second lens array including a plurality of second lenses, said second lenses being located in a matrix-like configuration in one-to-one correspondence with said plurality of first lenses so that said second lenses irradiate said display unit with said lights in such a manner that said lights are extended over a specified region and are superimposed on each other, said lights being converged by said first lens array.

24. A liquid crystal display apparatus according to claim 23, wherein said light source unit further includes a polarization beam splitter for permitting said superimposed light to pass through so as to irradiate said display unit with said light and so as to deflect a reflected light from said display unit, said superimposed light being transmitted from said second lens array.

* * * * *